US011326585B2

(12) United States Patent
Hayama et al.

(10) Patent No.: US 11,326,585 B2
(45) Date of Patent: May 10, 2022

(54) CAPACITY CONTROL VALVE

(71) Applicant: Eagle Industry Co., Ltd., Tokyo (JP)

(72) Inventors: Masahiro Hayama, Tokyo (JP); Yoshihiro Ogawa, Tokyo (JP); Keigo Shirafuji, Tokyo (JP); Kohei Fukudome, Tokyo (JP); Takahiro Ejima, Tokyo (JP); Daichi Kurihara, Tokyo (JP); Wataru Takahashi, Tokyo (JP)

(73) Assignee: EAGLE INDUSTRY CO., LTD.

( * ) Notice: Subject to any disclaimer, the term of this patent is extended or adjusted under 35 U.S.C. 154(b) by 118 days.

(21) Appl. No.: 16/772,711

(22) PCT Filed: Dec. 21, 2018

(86) PCT No.: PCT/JP2018/047177
§ 371 (c)(1),
(2) Date: Jun. 12, 2020

(87) PCT Pub. No.: WO2019/131482
PCT Pub. Date: Jul. 4, 2019

(65) Prior Publication Data

US 2020/0325881 A1 Oct. 15, 2020

(30) Foreign Application Priority Data

Dec. 25, 2017 (JP) ..... JP2017-248434

(51) Int. Cl.
*F04B 27/18* (2006.01)
*F04B 49/22* (2006.01)

(52) U.S. Cl.
CPC ..... *F04B 27/1804* (2013.01); *F04B 49/225* (2013.01); *F04B 2027/185* (2013.01);
(Continued)

(58) Field of Classification Search
CPC .. F04B 27/1009; F04B 27/1804; F04B 49/22; F04B 49/225; F04B 2027/1813;
(Continued)

(56) References Cited

U.S. PATENT DOCUMENTS 3,503,417 A * 3/1970 Todatadahide ..... F16K 17/0433 137/480
6,481,976 B2 * 11/2002 Kimura ..... F04B 27/1804 137/454.6

(Continued)

FOREIGN PATENT DOCUMENTS

| | | | |
|---|---|---|---|
| EP | 1852606 | 7/2007 | ..... F04B 27/18 |
| JP | 2014-47661 | 3/2014 | ..... F04B 27/14 |
| JP | 2014-95463 | 5/2014 | ..... F16K 31/06 |
| WO | WO 2007/119380 | 10/2007 | ..... F04B 2/14 |
| WO | WO 2014/119594 | 8/2014 | ..... F04B 27/14 |

OTHER PUBLICATIONS

Chinese Official Action issued in corresponding Chinese Patent Application No. 201880081056.0, dated Aug. 26, 2021, 8 pages.

(Continued)

*Primary Examiner* — Devon C Kramer
*Assistant Examiner* — Joseph S. Herrmann
(74) *Attorney, Agent, or Firm* — Hayes Soloway P.C.

(57) ABSTRACT

A capacity control valve includes a valve housing having a main valve seat portion formed on an inner peripheral surface, a main valve body that has a main valve portion capable of seating on the main valve seat portion and capable of blocking communication between a discharge port and a control port depending on a driving force of a solenoid, a relief valve that is opened by pressure, a first flow channel that allows the control port and a suction port to communicate with each other when the relief valve is opened. A second flow channel formed at least partially in parallel with the first flow channel allows the control port and the suction port to communicate with each other. A spool (Continued)

valve body is reciprocally disposed in a sleeve and capable of adjusting an opening of the second flow channel depending on the driving force of the solenoid.

13 Claims, 15 Drawing Sheets

(52) U.S. Cl.
CPC ..... *F04B 2027/1831* (2013.01); *F04B 2027/1845* (2013.01); *F04B 2027/1859* (2013.01); *F04B 2027/1881* (2013.01)

(58) Field of Classification Search
CPC ..... F04B 2027/1827; F04B 2027/1831; F04B 2027/1845; F04B 2027/185; F04B 2027/1859; F04B 2027/1863; F04B 2027/1868; F04B 2027/1881; F16K 10/11
See application file for complete search history.

(56) References Cited

U.S. PATENT DOCUMENTS

| | | | | |
|---|---|---|---|---|
| 8,079,827 | B2 * | 12/2011 | Iwa | F04B 27/1804 417/222.2 |
| 2009/0183786 | A1 | 7/2009 | Iwa et al. | 137/487.5 |
| 2014/0130916 | A1 | 5/2014 | Saeki et al. | F16K 31/06 |
| 2015/0345655 | A1 * | 12/2015 | Higashidozono | F04B 27/1804 137/624.27 |

OTHER PUBLICATIONS

International Search Report and Written Opinion issued in PCT/JP2018/047177, dated Mar. 26, 2020 with English translation, 17 pages.
International Preliminary Report on Patentability issued in PCT/JP2018/047177, dated Jun. 30, 2020, 6 pages.
Supplemental European Search Report issued in corresponding European Patent Application No. 18895992.8, dated Jun. 15, 2021, 8 pages.

* cited by examiner

CAPACITY CONTROL VALVE

TECHNICAL FIELD

The present invention relates to a capacity control valve that variably controls the volume or pressure of working fluid, for example, a capacity control valve that controls, in accordance with pressure, the amount of fluid to be discharged from a variable-capacity compressor used in an air-conditioning system for an automobile.

BACKGROUND ART

A variable-capacity compressor used in an air-conditioning system for an automobile or the like includes a rotating shaft that is rotationally driven by an engine, a swash plate that is connected to the rotating shaft so that an inclination angle thereof is variable, compression pistons that are connected to the swash plate, and the like; and changes the strokes of the pistons by the change of the inclination angle of the swash plate to control the amount of fluid to be discharged. The inclination angle of the swash plate can be continuously changed in a case where pressure in a control chamber is appropriately controlled while suction pressure Ps of a suction chamber, discharge pressure Pd of a discharge chamber, and control pressure Pc of the control chamber are used. The suction chamber sucks fluid using a capacity control valve driven to be opened/closed by an electromagnetic force, the discharge chamber discharges fluid pressurized by the pistons, and the control chamber houses the swash plate.

In a case where such a variable-capacity compressor is left in a stop state for a long time after the stop of the variable-capacity compressor, the suction pressure Ps, the discharge pressure Pd, and the control pressure Pc of the variable-capacity compressor become uniform pressure and the control pressure Pc and the suction pressure Ps are much higher than control pressure Pc and suction pressure Ps obtained during the continuous drive of the variable-capacity compressor (hereinafter, also referred to as "during the continuous drive" for short). Since the amount of fluid to be discharged cannot be appropriately controlled at the control pressure Pc much higher than the control pressure Pc obtained during the continuous drive, it is necessary to reduce the control pressure Pc by discharging fluid present in the control chamber. For this purpose, there is a capacity control valve that is adapted to discharge fluid from the inside of the control chamber of the variable-capacity compressor in a short time at the time of the startup of the variable-capacity compressor.

There is known a capacity control valve 100 disclosed in Patent Citation 1. As illustrated in FIG. 15, the capacity control valve 100 includes: a valve housing 110 including a first valve chamber 120 that is formed in the middle of discharge-side passages 112*a* and 112*b* allowing a discharge chamber and a control chamber of a variable-capacity compressor to communicate with each other, a second valve chamber 130 that is formed in the middle of suction-side passages 113*a* and 113*b* allowing a suction chamber and the control chamber to communicate with each other, and a third valve chamber 140 that is formed on one side of the first valve chamber 120 opposite to the second valve chamber 130; a valve body 150 integrally including a first valve part 152 that opens and closes the discharge-side passages 112*a* and 112*b* in the first valve chamber 120 and a second valve part 153 that opens and closes the suction-side passages 113*a* and 113*b* in the second valve chamber 130, and performing an opening operation and a closing operation opposite to each other by the reciprocation thereof; an intermediate communication passage 155 that is formed in the valve body 150 and allows the second valve chamber 130 and the third valve chamber 140 to communicate with each other; a pressure sensitive body 160 that is disposed in the third valve chamber 140, applies a biasing force to the first valve part 152 in the opening direction of a main valve by the expansion thereof, and contracts with an increase in the suction pressure Ps serving as surrounding pressure; an adapter 170 that is provided at the free end of the pressure sensitive body 160 in the expansion/contraction direction of the pressure sensitive body 160 and includes an annular valve seat; a third valve part 154 that is moved integrally with the valve body 150 in the third valve chamber 140 and can open/close the suction-side passages 113*a* and 113*b* by being seated on/separated from the adapter 170; and a solenoid 180 that applies a driving force to the valve body 150. In a case where the variable-capacity compressor is left in a stop state for a long time after the stop of the variable-capacity compressor, control pressure Pc and suction pressure Ps are much higher than pressure obtained during continuous drive. Accordingly, the pressure sensitive body 160 contracts due to surrounding pressure, so that the third valve part 154 is separated from the adapter 170 and a third valve is opened.

In a case where current is applied to the solenoid 180 of the capacity control valve 100 and the valve body 150 is moved at the time of the startup of the variable-capacity compressor, the first valve part 152 is moved in the closing direction of the main valve and the second valve part 153 is moved in the opening direction of a second valve. Accordingly, since the third valve chamber 140 and the second valve chamber 130 are caused to communicate with each other by the intermediate communication passage 155, the suction-side passages 113*a* and 113*b* are opened. Accordingly, high-pressure fluid present in the control chamber is discharged to the suction chamber from the third valve through the intermediate communication passage 155. After that, in a case where the suction pressure Ps and the control pressure Pc are reduced, the pressure sensitive body 160 is elastically restored and expands and the adapter 170 is seated on the third valve part 154 and closes the third valve.

CITATION LIST

Patent Literature

Patent Citation 1: JP 2014-47661 A (page 4, FIG. 1)

SUMMARY OF INVENTION

Technical Problem

However, in Patent Citation 1, the first valve part 152 closes the main valve and the second valve part 153 opens the second valve at the time of the startup of the variable-capacity compressor. Accordingly, high-pressure fluid present in the control chamber is discharged to the suction chamber from the third valve through the intermediate communication passage 155 and the suction-side passages 113*a* and 113*b* opened by the second valve part 153, so that the control pressure Pc of the control chamber is reduced with the startup of the variable-capacity compressor. However, in a case where the pressure sensitive body 160 is elastically restored and expands and the adapter 170 is seated on the third valve part 154 and closes the third valve before the control pressure Pc is reduced to a pressure close to pressure obtained during continuous drive, fluid cannot be discharged to the suction chamber from the control chamber any more. As a result, the control pressure Pc cannot be quickly reduced.

The present invention has been made in consideration of such a problem, and an object of the invention is to provide a capacity control valve that can quickly reduce pressure in a control chamber at the time of the startup of a variable-capacity compressor.

Solution to Problem

In order to solve the above-mentioned problem, a capacity control valve according to the present invention includes a valve housing having a main valve seat portion formed on an inner peripheral surface thereof, a main valve body that has a main valve portion capable of seating on the main valve seat portion and is capable of blocking communication between a discharge port through which discharge fluid having discharge pressure passes and a control port through which control fluid having control pressure passes depending on a driving force of a solenoid, a relief valve that is opened by pressure, a first flow channel that allows the control port and a suction port, through which sucked fluid having suction pressure passes, to communicate with each other in a case where the relief valve is opened, a second flow channel that is formed at least partially in parallel with the first flow channel and allows the control port and the suction port to communicate with each other, and a spool valve body that is reciprocatably disposed in a sleeve and capable of adjusting an opening of the second flow channel depending on the drive force of the solenoid. After the main valve portion is seated on the main valve seat portion, the spool valve body is further moved by the driving force of the solenoid and increases the opening of the second flow channel. According to this configuration, even though the relief valve is closed due to a reduction in the suction pressure and the control pressure obtained at the time of the startup of the variable-capacity compressor and the first flow channel allowing the control port and the suction port to communicate with each other is closed, the main valve portion of the main valve body is seated on the main valve seat portion depending on the driving force of the solenoid to close a main valve formed by the main valve portion and the main valve seat portion and the spool valve body is then further moved to increase the opening of the second flow channel. Accordingly, since high-pressure fluid present in the control chamber of the variable-capacity compressor can be discharged to the suction chamber through the second flow channel, pressure in the control chamber can be quickly reduced. Further, since the communication of the second flow channel is switched by the spool valve, the flow rate of fluid in the second flow channel can be accurately controlled.

Preferably, the spool valve body might be positioned at a position where the opening of the second flow channel is maintained at the minimum opening area when the main valve portion is seated on the main valve seat portion. According to this configuration, during the continuous drive of the variable-capacity compressor, a driving force of the solenoid, which is required to cause the main valve portion is seated on the main valve seat portion to close the main valve, is smaller than a driving force causing the spool valve body to move relative to the main valve body. Accordingly, since the spool valve body is not further moved from a state where the main valve portion is seated on the main valve seat portion, the opening of the second flow channel is maintained at the minimum opening area. As a result, pressure is easily controlled by the capacity control valve.

Preferably, the main valve body and the spool valve body might be disposed so as to be capable of reciprocating in an axial direction. According to this configuration, the structures of the main valve and the spool valve can be simplified.

Preferably, the first flow channel might be a hollow hole that is formed in the main valve body so as to extend in an axial direction of the main valve body. According to this configuration, the fluid can be discharged through the first flow channel, which is the hollow hole formed in the main valve body to extend in the axial direction, in a case where the relief valve is opened. Accordingly, since the first flow channel can ensure a large flow channel cross-sectional area, the pressure in the control chamber of the variable-capacity compressor can be quickly reduced.

Preferably, at least part of the second flow channel might is a through-hole formed in the valve housing. According to this configuration, the fluid can be discharged in parallel from two flow channels, that is, the first flow channel formed in the hollow hole of the main valve body and the second flow channel provided in the valve housing separately from the first flow channel. Accordingly, the pressure in the control chamber of the variable-capacity compressor can be quickly reduced.

Preferably, the main valve body and the spool valve body respectively might have protrusions protruding in opposite radial directions and be engaged with each other by bringing the protrusions into contact with each other. According to this configuration, even though the main valve body causes a malfunction in an open state in the valve housing, a force in the axial direction is applied to the main valve body by the spool valve body through the protrusions in contact with each other. Accordingly, the main valve portion can be separated from the main valve seat portion.

Preferably, a maximum separation distance in the axial direction between the main valve body and the spool valve body might be set to be shorter than a distance where the spool valve body is movable relative to the main valve body in the axial direction. According to this configuration, even though the main valve body causes a malfunction in a closed state in the valve housing, the spool valve body can be moved relative to the main valve body in the axial direction to come into contact with the main valve body and to apply a force to the main valve body in the axial direction. Accordingly, the main valve portion of the main valve body can be reliably seated on the main valve seat to close the main valve.

Preferably, the relief valve might be provided with an orifice portion that always allows the control port and the suction port to communicate with each other through the first flow channel. According to this configuration, the control port and the suction port can always communicate with each other through the first flow channel by the orifice portion in a case where the relief valve is closed. Accordingly, the pressure of the suction chamber and the pressure of the control chamber can be balanced and adjusted.

DESCRIPTION OF EMBODIMENTS

A capacity control valve according to the present invention will be described below on the basis of embodiments.

First Embodiment

A capacity control valve according to a first embodiment of the present invention will be described with reference to FIGS. 1 to 7. A left side and a right side in a case where the capacity control valve is viewed from the front side in FIG. 2 will be described as the left side and the right side of the capacity control valve.

Figure 1:
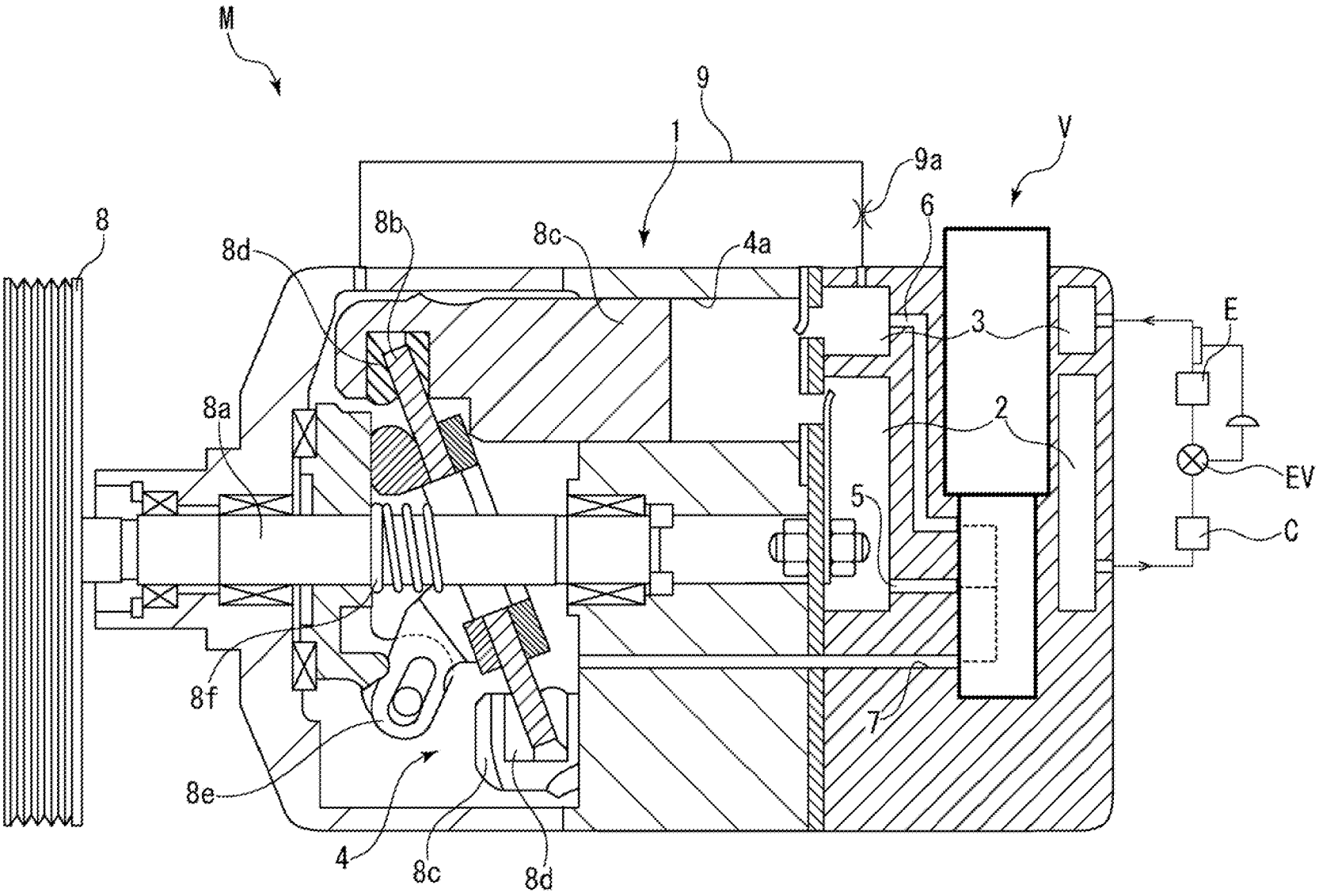
FIG. 1 is a diagram illustrating the schematic configuration of a variable-capacity swash plate compressor including a capacity control valve according to a first embodiment of the present invention.

As illustrated in FIG. 1, a capacity control valve V according to the first embodiment of the present invention is built in a variable-capacity compressor M used in an air-conditioning system for an automobile, and variably controls the pressure of working fluid (hereinafter, simply referred to as "fluid"), which is a refrigerant, to control the amount of the fluid to be discharged from the variable-capacity compressor M. The fluid discharged from the variable-capacity compressor M is sent to a condenser C forming a refrigeration cycle of the air-conditioning system, and is subjected to heat exchange while further passing through an expansion valve EV and an evaporator E.

First, the variable-capacity compressor M will be described. As illustrated in FIG. 1, the variable-capacity compressor M includes a casing 1. The casing 1 includes discharge chambers 2, suction chambers 3, a control chamber 4, and a plurality of cylinders 4*a*, and defines a communication passage 5 as a discharge-side passage allowing the discharge chamber 2 and the control chamber 4 to communicate with each other, a communication passage 6 serving as a suction-side passage allowing the suction chamber 3 and the control chamber 4 to communicate with each other, and a communication passage 7 functioning as both a discharge-side passage and a suction-side passage.

Further, the variable-capacity compressor M is provided with a communication passage 9 allowing the control chamber 4 and the suction chamber 3 to directly communicate with each other, and the communication passage 9 is provided with a stationary orifice 9*a* that balances and adjusts the pressure of the suction chambers 3 and the pressure of the control chamber 4.

Furthermore, the variable-capacity compressor M includes a driven pulley 8 that is provided outside the casing 1 and is connected to a V-belt (not illustrated), a rotating shaft 8*a* which protrudes to the outside of the casing 1 from the inside of the control chamber 4 and to which the driven pulley 8 is fixed, a swash plate 8*b* that is connected to the rotating shaft 8*a* in an eccentric state by a hinge mechanism 8*e*, a plurality of pistons 8*c* that are fitted into the cylinders 4*a* to be capable of reciprocating, a plurality of connecting members 8*d* that connect the swash plate 8*b* to the respective pistons 8*c*, and a spring 8*f* into which the rotating shaft 8*a* is inserted. A force is always applied to the swash plate 8*b* by the spring 8*f* and the hinge mechanism 8*e*.

The inclination angle of the swash plate 8*b* with respect to the rotating shaft 8*a* is changed in the variable-capacity compressor M by control pressure Pc in the control chamber 4, so that the strokes of the pistons 8*c* are variable. Specifically, as the control pressure Pc in the control chamber 4 is higher, the inclination angle of the swash plate 8*b* with respect to the rotating shaft 8*a* is smaller and the strokes of the pistons 8*c* are reduced. However, in a case where the control pressure Pc becomes a pressure equal to or higher than a certain level, the swash plate 8*b* is in a substantially vertical state (i.e., a state where the swash plate 8*b* is slightly inclined from a vertical state) with respect to the rotating shaft 8*a*. In this case, the strokes of the pistons 8*c* become the minimum, so that pressure applied to the fluid in the cylinders 4*a* by the pistons 8*c* becomes the minimum. Accordingly, the amount of the fluid to be discharged to the discharge chamber 2 is reduced, so that the cooling capacity of the air-conditioning system becomes the minimum. On the other hand, as the control pressure Pc in the control chamber 4 is reduced, the inclination angle of the swash plate 8*b* with respect to the rotating shaft 8*a* is larger and the strokes of the pistons 8*c* are increased. However, in a case where the control pressure Pc becomes a pressure equal to or lower than a certain level, the swash plate 8*b* has the maximum inclination angle with respect to the rotating shaft 8*a*. In this case, the strokes of the pistons 8*c* become the maximum, so that pressure applied to the fluid in the cylinders 4*a* by the pistons 8*c* becomes the maximum. Accordingly, the amount of the fluid to be discharged to the discharge chamber 2 is increased, so that the cooling capacity of the air-conditioning system becomes the maximum.

The capacity control valve V built in the variable-capacity compressor M variably controls the control pressure Pc in the control chamber 4 by adjusting current to be applied to a coil 87 of the solenoid 80, controlling the opening/closing of a first valve 57 serving as a main valve of the capacity control valve V, a second valve 58, and a spool valve 50, controlling the opening/closing of a relief valve 59 using surrounding fluid pressure, and controlling the fluid flowing into the control chamber 4 or flowing out of the control chamber 4.

In this embodiment, the first valve 57 includes a first valve body 53 serving as a main valve body and a valve seat 12*c* serving as a main valve seat portion that is formed on the inner peripheral surface of a valve housing 10 forming a communication passage 12*b*, and is adapted so that a first valve portion 53*a* serving as a main valve portion formed at the left end of the first valve body 53 in an axial direction comes into contact with and is separated from the valve seat 12*c*. The second valve 58 includes a second valve body 54 and an opening end face 83*g* of a sleeve portion 83*s* serving as a sleeve of a stationary core 83 forming a communication passage 13*b*, and is adapted so that a second valve portion 54*a* formed at the right end of the second valve body 54 in the axial direction comes into contact with and is separated from the opening end face 83*g*. The relief valve 59 includes an adapter 70 of a pressure sensitive body 60 and a valve seat 55*a* formed at the left end portion of a third valve body 55 in the axial direction, and is adapted so that a right end 70*a* of the adapter 70 in the axial direction comes into contact with and is separated from the valve seat 55*a*. The spool valve 50 includes a spool valve body 52 and the stationary core 83.

Figure 2:
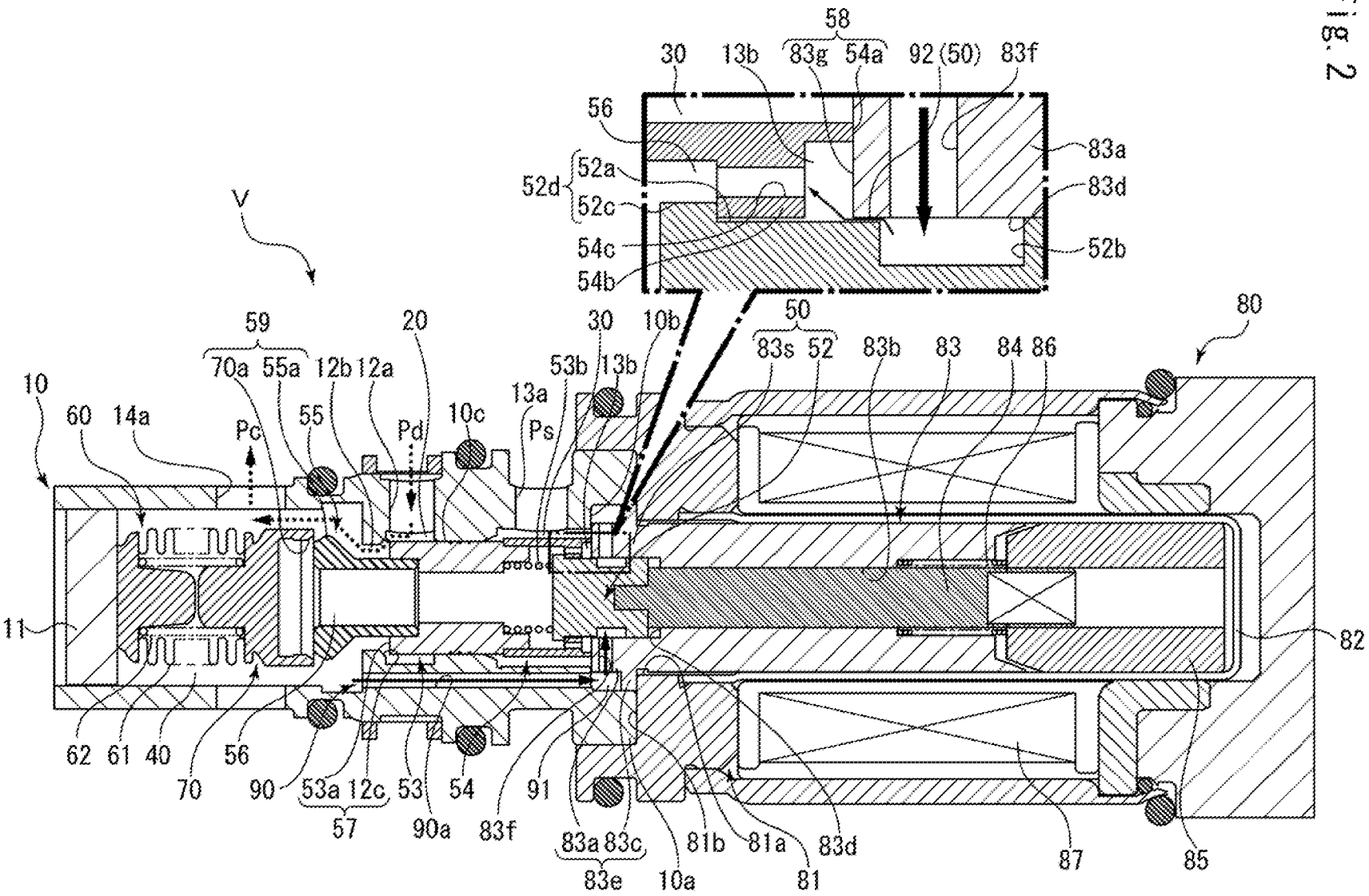
FIG. 2 is a cross-sectional view illustrating an aspect where a main valve is opened in a state where current is not applied to the capacity control valve according to the first embodiment (in a case where a relief valve is opened).
Figure 3:
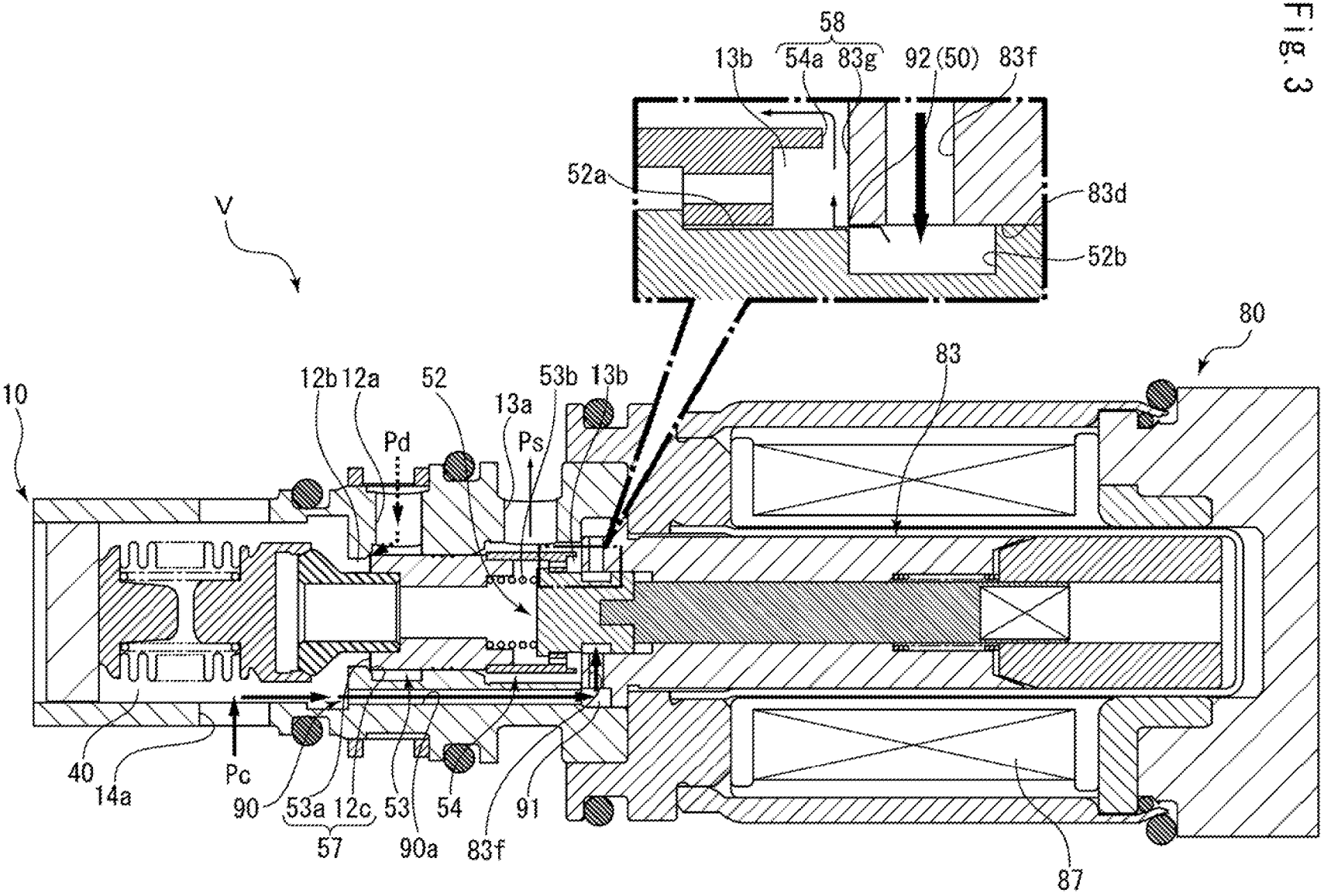
FIG. 3 is a cross-sectional view illustrating an aspect where the main valve is closed and a second valve is opened in a state where current is applied to the capacity control valve according to the first embodiment (during continuous drive).

Next, the structure of the capacity control valve V will be described. As illustrated in FIG. 2, the capacity control valve V mainly includes: the valve housing 10 that is made of a metal material or a resin material; the first valve body 53, the second valve body 54, the third valve body 55, and the spool valve body 52 that are arranged in the valve housing 10 to be capable of reciprocating in the axial direction; a pressure sensitive body 60 that applies a biasing force to the first valve body 53, the second valve body 54, the third valve body 55, and the spool valve body 52 to the right side in the axial direction; and a solenoid 80 that is connected to the valve housing 10 and exerts a driving force to the first valve body 53, the second valve body 54, the third valve body 55, and the spool valve body 52.

As illustrated in FIG. 2, the solenoid 80 mainly includes a casing 81 that includes an opening portion 81*a* opened to the left side in the axial direction, a bottomed cylindrical sleeve 82 that is fixed to the inner diameter side of the casing 81, a substantially cylindrical stationary core 83 that is inserted into the opening portion 81*a* of the casing 81 from the left side in the axial direction and is fixed to the inner diameter sides of the casing 81 and the sleeve 82, a driving rod 84 which can reciprocate in the axial direction on the inner diameter side of the stationary core 83 and of which the left end portion in the axial direction is connected to the spool valve body 52, a movable core 85 that is disposed on the inner diameter side of the sleeve 82 and is fixed to the right end portion of the driving rod 84 in the axial direction, a coil spring 86 that is provided between the stationary core 83 and the movable core 85 and biases the movable core 85 to the right side in the axial direction, and an exciting coil 87 that is wound on the outside of the sleeve 82 with a bobbin interposed therebetween.

A recessed portion 81*b* that is recessed to the right side in the axial direction from the radial center of the left end of the casing 81 in the axial direction is formed at the casing 81, and a mounting portion 10*a* formed at the right end of the valve housing 10 in the axial direction is inserted into the recessed portion 81*b*.

The stationary core 83 includes: a cylindrical portion 83*a* that is formed of a rigid body made of a magnetic material, such as iron or silicon steel, and includes an insertion hole 83*b* into which the driving rod 84 extending in the axial direction is inserted; and an annular flange portion 83*c* that extends radially outward from the outer peripheral surface of the left end portion of the cylindrical portion 83*a* in the axial direction. A recessed portion 83*d* recessed rightward in the axial direction from the radial center of the left end of the cylindrical portion 83*a* in the axial direction is formed at the stationary core 83. Since the flange portion 83*c* extends radially outward from a position that is closer to the right side in the axial direction than the left end of the cylindrical portion 83*a* in the axial direction, an annular stepped portion 83*e* is formed at the left end portion of the stationary core 83 in the axial direction by the left end face of the flange portion 83*c* in the axial direction and the outer peripheral surface of the cylindrical portion 83*a* that is orthogonal to the left end face of the flange portion 83*c* and extends to the left end of the stationary core 83 in the axial direction.

A plurality of through-holes 83*f* that extend in a radial direction to communicate with the recessed portion 83*d* formed on the inner diameter side in the cylindrical portion 83*a* is formed in the annular stepped portion 83*e*.

Further, the flange portion 83*c* of the stationary core 83 is disposed on the inner diameter side in the recessed portion 81*b* of the casing 81, the mounting portion 10*a* of the valve housing 10 is disposed on the outer diameter side in the recessed portion 81*b*, and the flange portion 83*c* of the stationary core 83 is inserted into a recessed portion 10*b* that is recessed leftward in the axial direction from the radial center of the right end of the mounting portion 10*a* of the valve housing 10 in the axial direction. In this case, the flange portion 83*c* of the stationary core 83 is brought into contact with the bottom of the recessed portion 81*b* of the casing 81, and is fixed to the casing 81 in a state where the outer diameter side of the opening end face 83*g* formed at the left end of the cylindrical portion 83*a* (sleeve portion 83*s*) in the axial direction is brought into contact with the bottom of the recessed portion 10*b* of the valve housing 10.

As illustrated in FIG. 2, an adjustable partition member 11 is press-fitted into the left end portion of the valve housing 10 in the axial direction, so that the valve housing 10 has substantially the shape of a bottomed cylinder. The first valve body 53, the second valve body 54, the third valve body 55, and the spool valve body 52 are arranged in the valve housing 10 to be capable of reciprocating in the axial direction, and a small-diameter guide surface 10*c* with which the outer peripheral surface of the first valve body 53 can be in sliding contact is formed on a part of the inner peripheral surface of the valve housing 10. The adjustable partition member 11 is adapted to be capable of adjusting the biasing force of the pressure sensitive body 60 by the adjustment of a position where the adjustable partition member 11 is installed in the axial direction of the valve housing 10.

Further, the valve housing 10 includes communication passages 12*a* and 12*b* serving as a discharge port that functions as a discharge-side passage allowing the discharge chamber 2 and the control chamber 4 of the variable-capacity compressor M to communicate with each other, a communication passage 14*a* serving as a control port, communication passages 13*a* and 13*b* serving as an suction port that functions as a suction-side passage allowing the control chamber 4 and the suction chamber 3 of the variable-capacity compressor M to communicate with each other together with a first communication passage 56 serving as a hollow hole and a first flow channel to be described later and a second communication passage 90 serving as a second flow channel formed at least partially in parallel with the first flow channel, a first valve chamber 20 that is formed in the middle of the discharge-side passage, a second valve chamber 30 that is formed in the middle of a suction-side passage, and a third valve chamber 40 that is formed at a position opposite to the second valve chamber 30 with respect to the first valve chamber 20. The communication passage 13*b* is defined by the opening end face 83*g* of the sleeve portion 83*s* of the stationary core 83, the second valve body 54, and the spool valve body 52.

Furthermore, a through-hole 90*a* penetrating the valve housing 10 in the axial direction is formed on the outer diameter side in the valve housing 10. The through-hole 90*a* forms a part of the second communication passage 90 that allows the second valve chamber 30 and the third valve chamber 40 to communicate with each other in the valve housing 10.

The second communication passage 90 mainly includes the through-hole 90*a* that penetrates the valve housing 10 in the axial direction, an annular connecting space 91 that is formed in a case where the flange portion 83*c* of the stationary core 83 is inserted into the recessed portion 10*b* of the valve housing 10, a through-hole 83*f* that penetrates the cylindrical portion 83*a* of the stationary core 83 in the radial direction, and an annular groove portion 52*b* that is provided on an outer peripheral surface 52*a* of the spool valve body 52 to be described later. The connecting space 91 is defined by the inner peripheral surface and the bottom of the recessed portion 10*b* of the valve housing 10 and the annular stepped portion 83*e* of the stationary core 83. Further, the second communication passage 90 always communicates with the communication passage 13*b* that functions as a suction-side passage through a spool-adjustment flow channel 92 continuous with the annular groove portion 52*b*. The spool-adjustment flow channel 92 (second communication passage 90) is adapted so that the opening of the spool-adjustment flow channel 92 can be adjusted by the spool valve 50 including the spool valve body 52 and the sleeve portion 83*s* of the stationary core 83. The spool valve 50 and the adjustment of an opening using the spool valve 50 will be described in detail later.

As illustrated in FIG. 2, a compressed coil spring 53*b* is provided between the first valve body 53 and the spool valve body 52. In a case where the driving force of the solenoid 80 exceeds the biasing force of the coil spring 53*b*, the coil spring 53*b* is compressed.

The first valve body 53 is formed in a substantially cylindrical shape, the substantially cylindrical second valve body 54 is fixed to the right end portion of the first valve body 53 in the axial direction, the substantially cylindrical third valve body 55 is fixed to the left end portion of the first valve body 53 in the axial direction, and the first valve body 53, the second valve body 54, and the third valve body 55 are adapted to be integrally moved in the axial direction. The first communication passage 56, which penetrates the first valve body 53, the second valve body 54, and the third valve body 55 in the axial direction and functions as a suction-side passage, is formed in the first valve body 53, the second valve body 54, and the third valve body 55 by the connection of hollow holes.

The pressure sensitive body 60 mainly includes a bellows core 61 in which a coil spring 62 is built and an adapter 70 that is formed at the right end portion of the bellows core 61 in the axial direction. The left end of the bellows core 61 in the axial direction is fixed to the adjustable partition member 11.

Further, the pressure sensitive body 60 is disposed in the third valve chamber 40, and is adapted so that a right end 70*a* of the adapter 70 in the axial direction is seated on the valve seat 55*a* of the third valve body 55 by the biasing forces of the coil spring 62 and the bellows core 61. FIG. 2 illustrates a state where, in a case where the capacity control valve V is left for a long time in a state where current is not applied, suction pressure Ps of the first communication passage 56 becomes much higher than pressure obtained during continuous drive, the pressure sensitive body 60 contracts, the right end 70*a* of the adapter 70 in the axial direction is separated from the valve seat 55*a* of the third valve body 55, and the relief valve 59 is opened.

The spool valve body 52 is formed separately from the first valve body 53, is connected and fixed to the driving rod 84 of the solenoid 80 in a state where the right end portion of the spool valve body 52 in the axial direction is inserted into the recessed portion 83*d* of the stationary core 83, and is adapted to be capable of being moved to the left side in the axial direction by the driving force of the solenoid 80. In this way, the left end side of the stationary core 83 where the recessed portion 83*d* is formed forms the sleeve portion 83*s* serving as a sleeve where the spool valve body 52 is disposed to be movable in the axial direction. The outer peripheral surface 52*a* of the spool valve body 52 and the inner peripheral surface of the recessed portion 83*d* of the stationary core 83 are slightly separated from each other in the radial direction, so that a small gap is formed therebetween. Accordingly, the spool valve body 52 can be smoothly moved in the axial direction.

Further, the spool valve body 52 is connected to the first valve body 53 through the coil spring 53*b* in a state where the spool valve body 52 is biased to the right side in the axial direction by the coil spring 53*b* inserted into the right end portion of the first valve body 53 in the axial direction. Since the control pressure Pc in the third valve chamber 40 and the suction pressure Ps of the first communication passage 56 are controlled by the capacity control valve V during continuous drive, the pressure sensitive body 60 is in a state where the pressure sensitive body 60 can contract. Accordingly, the first valve body 53 and the spool valve body 52 can be integrally moved to the left side in the axial direction by the driving force of the solenoid 80 to close the first valve 57 (see FIG. 3). Since the driving force of the solenoid 80 during continuous drive is smaller than the biasing force of the coil spring 53*b*, the coil spring 53*b* does not contract. Accordingly, the first valve body 53 and the spool valve body 52 are not moved relative to each other in the axial direction. Furthermore, in a state where the control pressure Pc and the suction pressure Ps are controlled by the capacity control valve V, the pressure sensitive body 60 is not caused to expand and contract by surrounding pressure and expands and contracts according to the movement of the first valve body 53 and the spool valve body 52 while the closed state of the relief valve 59 is maintained.

Further, an annular groove portion 52*b*, which is recessed radially inward over the circumferential direction, is formed substantially in the middle of the outer peripheral surface 52*a* of the spool valve body 52 in the axial direction. Furthermore, an annular flange portion 52*c*, which extends radially outward, is formed at the left end of the outer peripheral surface 52*a* in the axial direction, and an annular stepped portion 52*d* is formed at the left end portion of the spool valve body 52 in the axial direction by the right end face of the flange portion 52*c* in the axial direction and the outer peripheral surface 52*a* that is orthogonal to this end face and extends to the right side in the axial direction.

The annular stepped portion 52*d* of the spool valve body 52 is biased to the right side in the axial direction by the coil spring 53*b* in a state where the right end face of the flange portion 52*c* in the axial direction is engaged with the left end face of an annular protrusion 54*b*, which extends radially inward from the right end portion of the inner peripheral surface of the second valve body 54 in the axial direction, in the axial direction from the inner diameter side in the radial direction. A plurality of through-holes 54*c* extending in the axial direction are formed in the annular protrusion 54*b* of the second valve body 54, so that the first communication passage 56 formed in the first valve body 53 and the communication passage 13*b* functioning as a suction-side passage always communicate with each other through the through-holes 54*c*.

Further, since the outer peripheral surface 52*a* of the spool valve body 52 is formed so that the outer diameter of the outer peripheral surface 52*a* closer to the left side than the annular groove portion 52*b* in the axial direction is slightly smaller than the outer diameter of a portion thereof closer to the right side than the annular groove portion 52*b* in the axial direction, the outer peripheral surface 52*a* closer to the left side than the annular groove portion 52*b* of the spool valve body 52 in the axial direction and the inner peripheral surface of the recessed portion 83*d* of the stationary core 83 are separated from each other in the radial direction. Accordingly, an annular spool-adjustment flow channel 92 through which fluid can pass is formed. The opening of the spool-adjustment flow channel 92 is adjusted by the spool valve 50. In detail, the opening of the spool-adjustment flow channel 92 can be adjusted by a change in the position of the spool valve body 52 relative to the stationary core 83 of the spool valve 50 in the axial direction. As illustrated in FIG. 2, a predetermined axial range of the outer peripheral surface 52*a* closer to the left side than the annular groove portion 52*b* of the spool valve body 52 in the axial direction is adapted to enter the recessed portion 83*d* of the stationary core 83 in a state where current is not applied to the capacity control valve V (i.e., a state where the second valve 58 is closed). Further, the opening area of the second communication passage 90, which is determined by the opening of the spool-adjustment flow channel 92 in a state where current is not applied to the capacity control valve V, is the minimum opening area S1 (see FIG. 7). Furthermore, the minimum opening area S1 of the second communication passage 90 may be freely set by the adjustment of a radial separation distance between the outer peripheral surface 52*a* of the spool valve body 52 and the inner peripheral surface of the recessed portion 83*d* of the stationary core 83.

Next, an aspect of a state where a state where current is not applied to the capacity control valve V is continued will be described in detail. As illustrated in FIG. 2, in a state where current is not applied to the capacity control valve V, the movable core 85 is pressed to the right side in the axial direction by the biasing force of the coil spring 86 of the solenoid 80 or the biasing forces of the coil spring 62 and the bellows core 61. Accordingly, the driving rod 84, the first valve body 53, the second valve body 54, the third valve body 55, and the spool valve body 52 are moved to the right side in the axial direction and the second valve portion 54*a* of the second valve body 54 of the second valve 58 is seated on the opening end face 83*g* of the sleeve portion 83*s* of the stationary core 83, so that the communication passages 13*a* and 13*b* serving as a suction-side passage are closed. In this case, the first valve portion 53*a* of the first valve body 53 of the first valve 57 is separated from the valve seat 12*c* formed on the inner peripheral surface of the valve housing 10, so that the communication passages 12*a*, 12*b*, and 14*a* (illustrated in FIG. 2 by dotted arrows) serving as a discharge-side passage are opened.

Since the communication passages 12*a*, 12*b*, and 14*a* serving as a discharge-side passage are opened by the capacity control valve V in this way in a state where current is not applied to the capacity control valve V, fluid present in the discharge chamber 2 of the variable-capacity compressor M flows into the control chamber 4 from the discharge chamber 2 through the capacity control valve V. The reason for this is that discharge pressure Pd is higher than the control pressure Pc.

Since the fluid of the discharge pressure Pd flows into the control chamber 4, the control pressure Pc is higher than control pressure Pc, which is obtained before a state where current is not applied, and is higher than the suction pressure Ps. This is represented by a relational expression of "$Ps<Pc\leq Pd$". For this reason, the fluid present in the control chamber 4 flows into the suction chamber 3 through the communication passage 9 and the stationary orifice 9*a*. The inflow of the fluid is performed until the discharge pressure Pd, the suction pressure Ps, and the control pressure Pc are balanced. For this reason, in a case where the capacity control valve V is left for a long time in a state where current is not applied, the discharge pressure Pd, the suction pressure Ps, and the control pressure Pc are balanced and become uniform pressure ($Ps=Pc=Pd$) and the suction pressure Ps and the control pressure Pc become much higher than pressure obtained during continuous drive. Since the suction pressure Ps becomes much higher than pressure obtained during continuous drive in this way, the pressure sensitive body 60 contracts and the relief valve 59 is opened.

Since the amount of the fluid to be discharged from the variable-capacity compressor M cannot be appropriately controlled under the control pressure Pc that is much higher than pressure obtained during continuous drive, it is necessary to discharge fluid from the inside of the control chamber 4 to reduce the control pressure Pc.

Next, an aspect until fluid is discharged from the control chamber 4 at the time of the startup of the variable-capacity compressor M will be described in detail with reference to FIGS. 1, 2, and 4 to 6.

In a case where the variable-capacity compressor M is started up in a state where the discharge pressure Pd, the suction pressure Ps, and the control pressure Pc are uniform pressure, the control pressure Pc at this time is much higher than control pressure Pc obtained during continuous drive. Accordingly, since the swash plate 8*b* is substantially perpendicular to the rotating shaft 8*a*, the strokes of the pistons 8*c* are minimum. Further, the variable-capacity compressor M starts to apply current to the capacity control valve V in response to its own startup.

Figure 4:
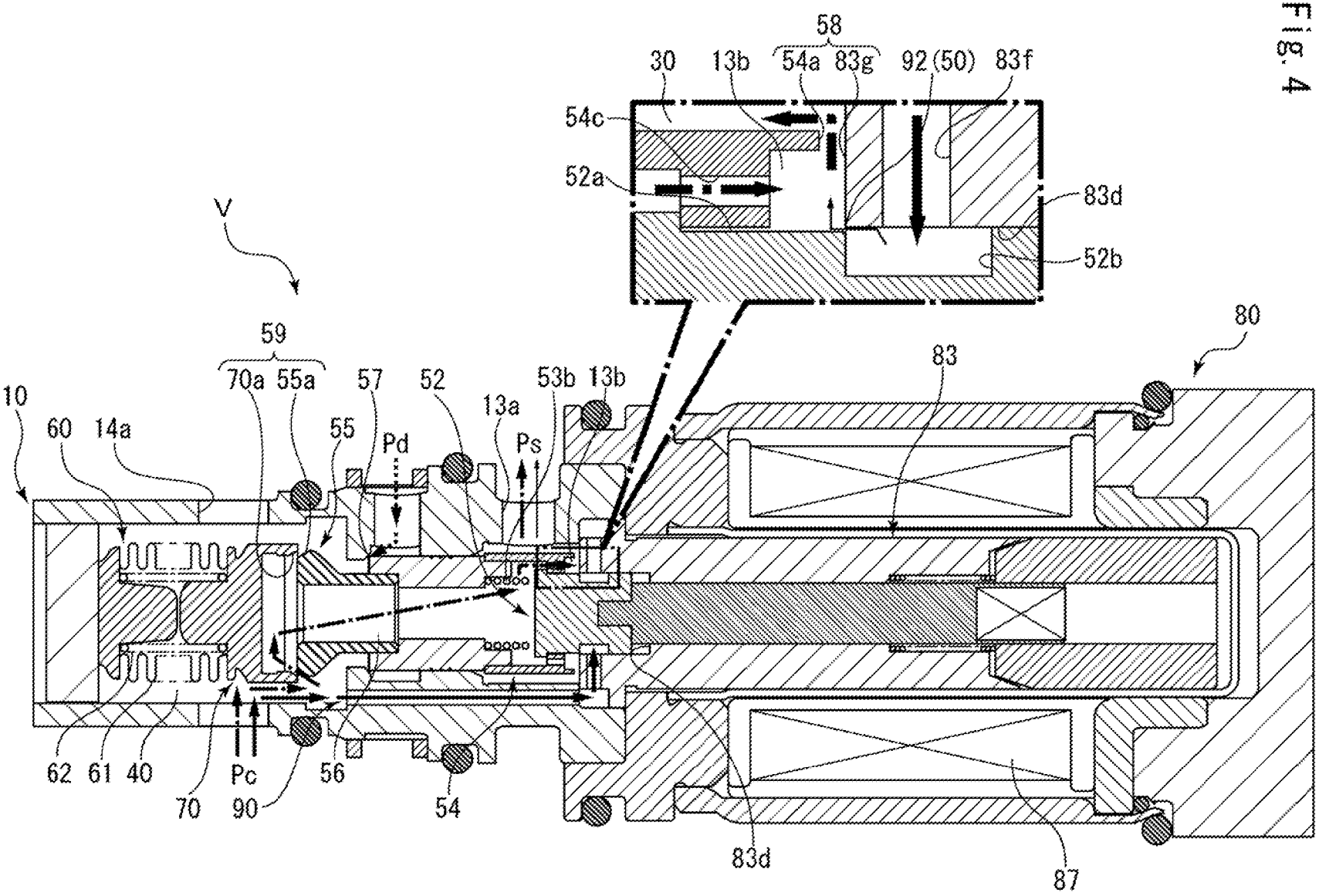
FIG. 4 is a cross-sectional view illustrating a state where a spool valve body is not moved relative to a first valve body in an axial direction by the driving force of a solenoid and a spool valve is closed in a state where current is applied to the capacity control valve according to the first embodiment (in a case where the relief valve is opened).

The capacity control valve V is excited and generates a magnetic force in a case where current is applied to the coil 87 of the solenoid 80 from a state which is illustrated in FIG. 2 and in which current is not applied, the movable core 85 is attracted to the stationary core 83 affected by this magnetic force, the driving rod 84 of which the right end portion in the axial direction is connected to the movable core 85 is driven, and the spool valve body 52 connected to the left end portion of the driving rod 84 in the axial direction is moved to the left side in the axial direction (see FIG. 4). In this case, the first valve body 53, the second valve body 54, the third valve body 55, and the spool valve body 52 are integrally moved to the left side in the axial direction.

Accordingly, as illustrated in FIG. 4, the first valve portion 53*a* of the first valve body 53 is seated on the valve seat 12*c* formed on the inner peripheral surface of the valve housing 10 in the capacity control valve V, so that the first valve 57 is closed between the communication passages 12*a* and 12*b* serving as a discharge-side passage (illustrated in FIG. 4 by dotted arrows). In this case, the second valve portion 54*a* of the second valve body 54 is separated from the opening end face 83*g* of the sleeve portion 83*s* of the stationary core 83, so that the second valve 58 is opened between the communication passages 13*a* and 13*b* serving as a suction-side passage. The first valve portion 53*a* of the first valve body 53 of the first valve 57 is seated on the valve seat 12*c* formed on the inner peripheral surface of the valve housing 10 by a magnetic force obtained at the time of the startup of the capacity control valve V, the opening of the second valve 58 is maximum when the first valve 57 is closed, and the opening area of a suction-side passage between the communication passages 13*a* and 13*b* determined by the opening of the second valve 58 is the maximum opening area (see FIG. 7).

Further, in a case where the second valve 58 is opened between the communication passages 13*a* and 13*b* serving as a suction-side passage in the capacity control valve V, two flow channels, that is, a flow channel (illustrated in FIG. 4 by dot-dashed arrows) extending from the control chamber 4 to the communication passage 14*a*, the third valve chamber 40, the first communication passage 56, the through-hole 54*c*, the communication passage 13*b*, the second valve chamber 30, and the communication passage 13*a* in this order and a flow channel (illustrated in FIG. 4 by solid arrows) extending from the control chamber 4 to the communication passage 14*a*, the third valve chamber 40, the second communication passage 90 (the through-hole 90*a*, the connecting space 91, the through-hole 83*f*, the annular groove portion 52*b*, and the spool-adjustment flow channel 92), the second valve chamber 30, the communication passage 13*b*, and the communication passage 13*a* in this order are formed in parallel.

As illustrated in FIG. 4, when the first valve 57 is closed (in a state where the driving force of the solenoid 80 is substantially equal to or smaller than the biasing force of the coil spring 53*b* provided between the first valve body 53 and the spool valve body 52), the coil spring 53*b* provided between the first valve body 53 and the spool valve body 52 does not contract and the axial position of the right end of the outer peripheral surface 52*a*, which is closer to the left side than the annular groove portion 52*b* of the spool valve body 52 of the spool valve 50 in the axial direction, in the axial direction and the axial position of the opening end face 83*g* of the sleeve portion 83*s* of the stationary core 83 are maintained at substantially the same position. Accordingly, the opening of the spool-adjustment flow channel 92 is not changed from a state where current is not applied to the capacity control valve V, and the second communication passage 90 is maintained at the minimum opening area S1 (see FIG. 7). For this reason, the amount of fluid flowing into the communication passages 13*a* and 13*b* serving as a suction-side passage is very small (illustrated in an enlarged portion of FIG. 4 by solid arrows).

Figure 5:
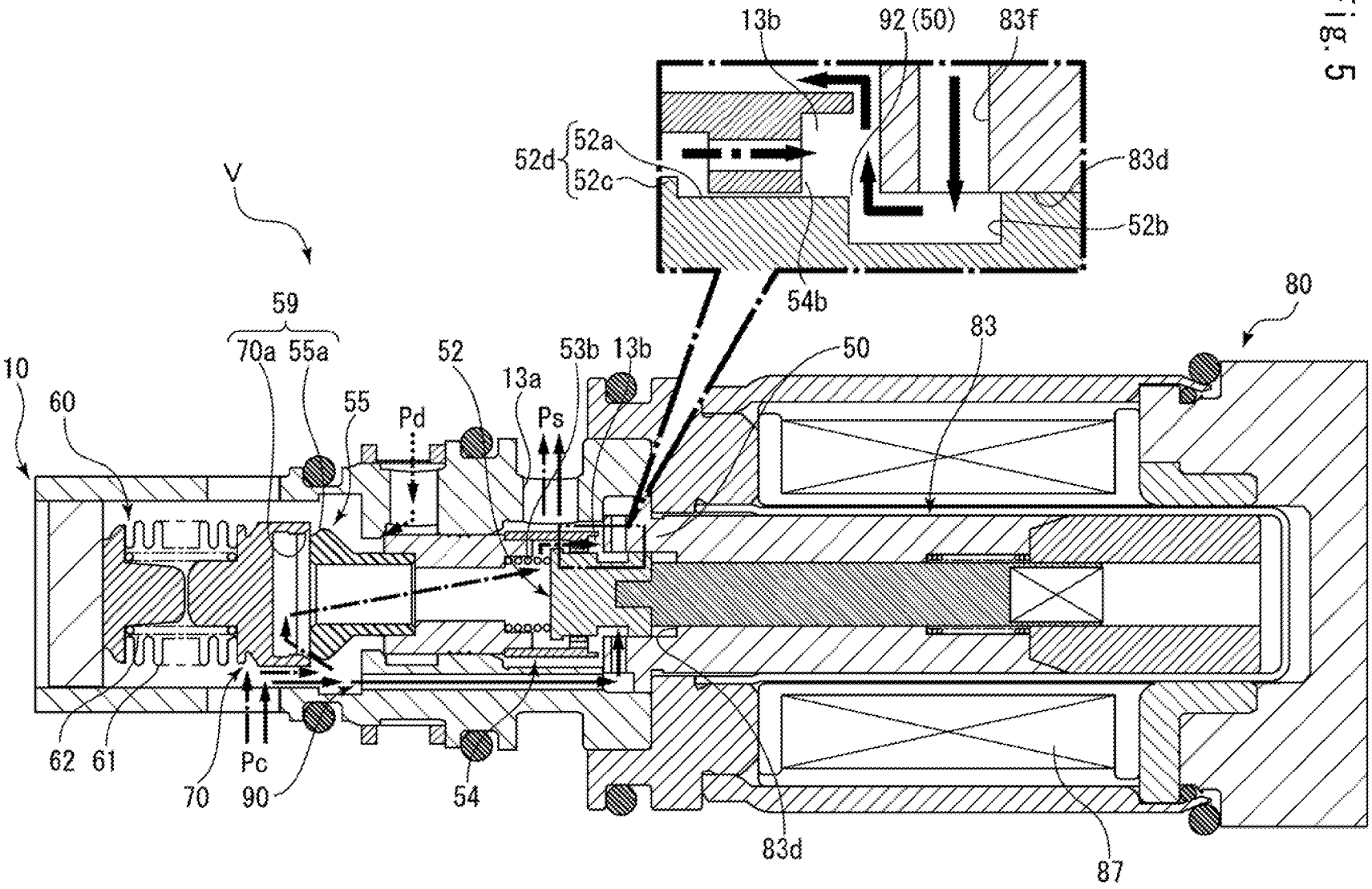
FIG. 5 is a cross-sectional view illustrating a state where the spool valve body is moved relative to the first valve body in the axial direction by the driving force of the solenoid and the spool valve is opened in a state where current is applied to the capacity control valve according to the first embodiment (in a case where the relief valve is opened).
Figure 6:
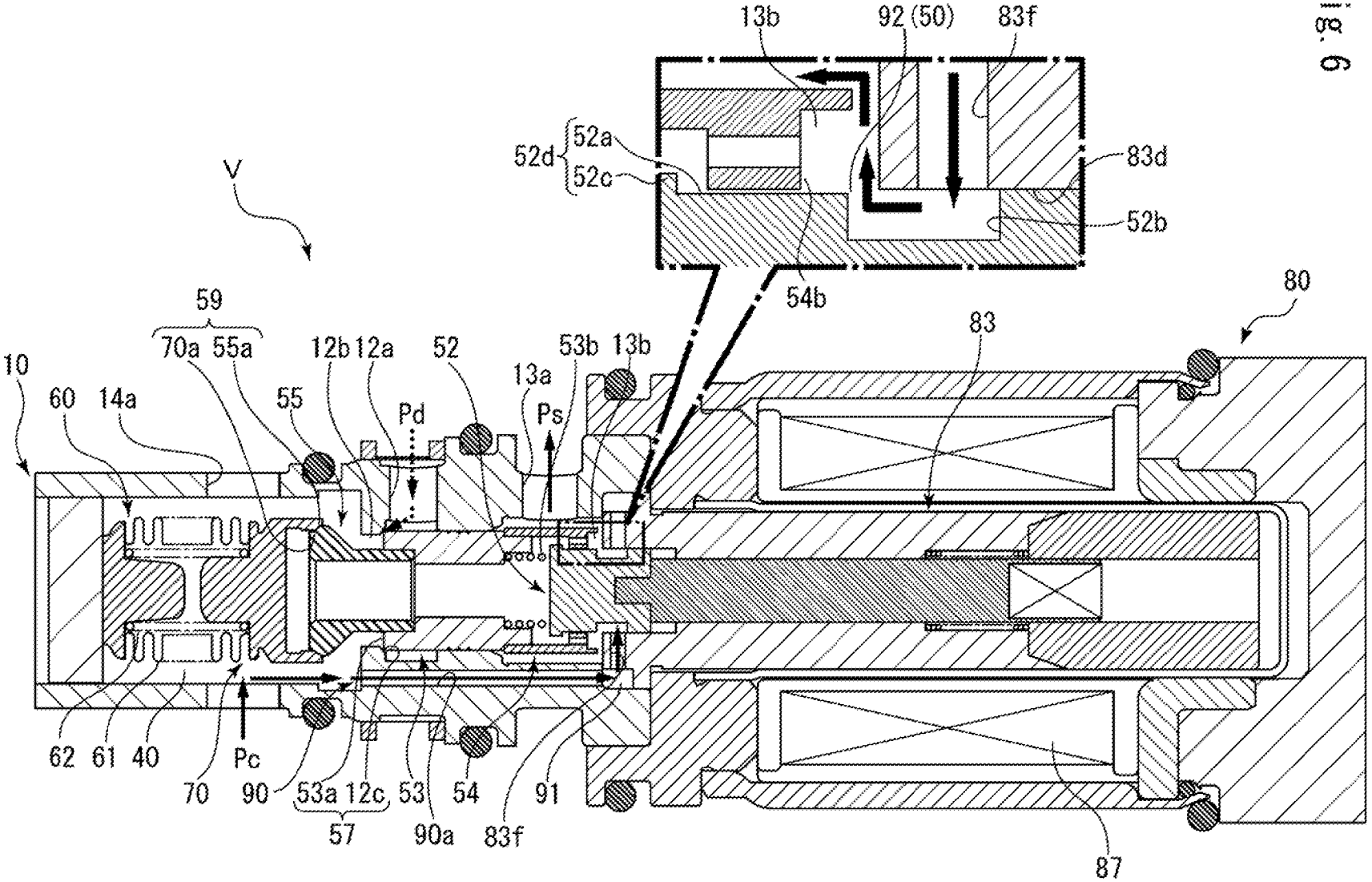
FIG. 6 is a cross-sectional view illustrating a state where the spool valve body is moved relative to the first valve body in the axial direction by the driving force of the solenoid and the spool valve is opened in a state where current is applied to the capacity control valve according to the first embodiment (in a case where the relief valve is closed).
Figure 7:
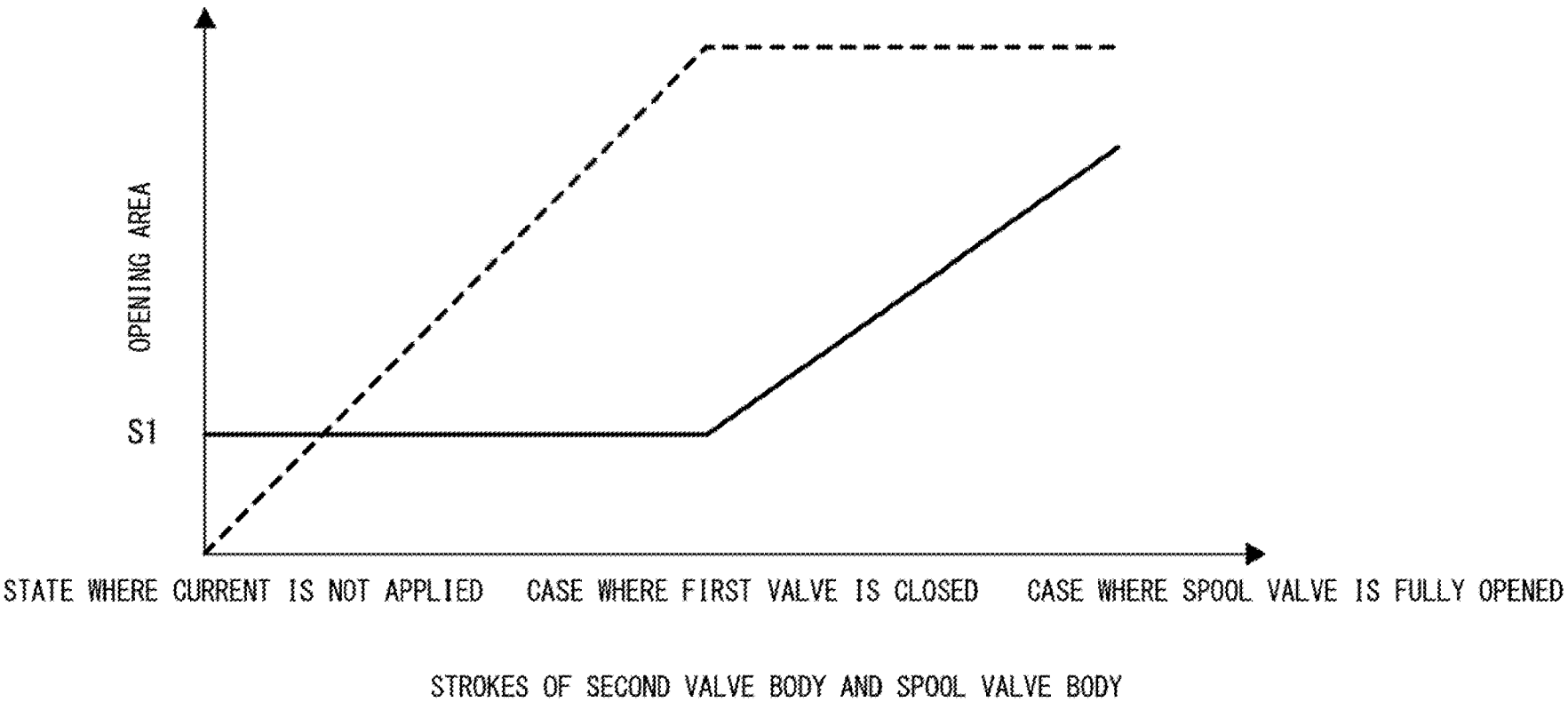
FIG. 7 is a graph showing a change in the opening areas of a second communication passage (adjusted by the spool valve) and a suction-side passage (adjusted by the second valve) of which the openings are adjusted by a second valve body and the spool valve body of the capacity control valve according to the first embodiment, and in which a horizontal axis represents the strokes of the second valve body and the spool valve body to be driven by the solenoid and a vertical axis represents the opening areas of the second communication passage and the suction-side passage.

After that, the variable-capacity compressor M is controlled to increase current to be applied to the capacity control valve V after the first valve 57 is closed. Since current to be applied to the coil 87 of the solenoid 80 is increased from a state which is illustrated in FIG. 4 and in which the first valve 57 has been closed, the capacity control valve V generates a large magnetic force. Accordingly, in a case where the driving force of the solenoid 80 exceeds the biasing force of the coil spring 53*b* provided between the first valve body 53 and the spool valve body 52, as illustrated in FIG. 5, the coil spring 53*b* contracts and the right end face of the flange portion 52*c*, which forms the annular stepped portion 52*d* of the spool valve body 52, in the axial direction is separated from the left end face of the annular protrusion 54*b* of the second valve body 54 in the axial direction. Accordingly, engagement is released and the spool valve body 52 is relatively moved to the left side in the axial direction so as to approach the first valve body 53.

Therefore, in the capacity control valve V, as illustrated in FIG. 5, the outer peripheral surface 52*a*, which is closer to the left side than the annular groove portion 52*b* of the spool valve body 52 of the spool valve 50 in the axial direction, and a part of the annular groove portion 52*b* is released from the recessed portion 83*d* of the stationary core 83 to the left side in the axial direction and are positioned closer to the left side than the opening end face 83*g* in the axial direction, so that the opening of the spool-adjustment flow channel 92 is increased. Accordingly, the opening area of the second communication passage 90 is increased proportionally together with the stroke of the spool valve body 52 (see FIG. 7).

According to this, the capacity control valve V can discharge fluid from the inside of the control chamber 4 in a short time by two parallel flow channels, that is, a flow channel (illustrated in FIG. 5 by dot-dashed arrows) communicating with the first communication passage 56 in a case where the relief valve 59 is opened and a flow channel (illustrated in FIG. 5 by a solid arrow) communicating with the second communication passage 90 of which the opening area is increased in a case where the spool valve 50 is opened. Accordingly, the control pressure Pc in the control chamber 4 can be quickly reduced at the time of the startup of the variable-capacity compressor M.

Next, due to a reduction in the control pressure Pc in the control chamber 4, the surrounding pressure around the pressure sensitive body 60 is reduced and the suction pressure Ps in the suction chambers 3 is reduced. Accordingly, the pressure sensitive body 60 expands, the right end 70*a* of the adapter 70 in the axial direction is seated on the valve seat 55*a* of the third valve body 55, and the relief valve 59 is closed (see FIG. 6).

Further, even though the pressure sensitive body 60 expands and the relief valve 59 is closed since the magnitude of current to be applied to the capacity control valve V is maintained, the closing of the first valve 57 can be maintained by the driving force of the solenoid 80 and the opening of the spool valve 50 can be maintained by the contraction of the coil spring 53*b* provided between the first valve body 53 and the spool valve body 52.

According to this, even though the pressure sensitive body 60 expands due to a reduction in the suction pressure Ps in the first communication passage 56 at the time of the startup of the variable-capacity compressor M, the relief valve 59 is closed, and the first communication passage 56 forming a suction-side passage allowing the control chamber 4 and the suction chamber 3 to communicate with each other is closed, the capacity control valve V of this embodiment controls current to be applied to the capacity control valve V, causes the first valve portion 53*a* of the first valve body 53 to be seated on the valve seat 12*c* formed on the inner peripheral surface of the valve housing 10 by the driving force of the solenoid 80 to cause the first valve 57 to be closed, and then causes the coil spring 53*b* provided between the first valve body 53 and the spool valve body 52 to contract to further move the spool valve body 52 to the left side in the axial direction, to open the spool valve 50, and to increase the opening of the second communication passage 90 (spool-adjustment flow channel 92). Accordingly, since the capacity control valve V can discharge high-pressure fluid, which is present in the control chamber 4 of the variable-capacity compressor M, to the suction chamber 3 through the second communication passage 90, the control pressure Pc in the control chamber 4 can be quickly reduced. In a case where the control pressure Pc in the third valve chamber 40 and the suction pressure Ps in the first communication passage 56 are reduced to a pressure close to pressure obtained during continuous drive, the pressure sensitive body 60 expands, the right end 70*a* of the adapter 70 in the axial direction is seated on the valve seat 55*a* of the third valve body 55, and the relief valve 59 is closed.

Further, since the driving force of the solenoid 80 is adjusted not to exceed the biasing force of the coil spring 53*b* during the continuous drive of the variable-capacity compressor M, the opening area of the second communication passage 90 determined by the opening of the spool-adjustment flow channel 92 in the spool valve 50 can be maintained at the minimum opening area S1. Accordingly, the amount of fluid flowing into the communication passages 13*a* and 13*b*, which serve as a suction-side passage, from the second communication passage 90 can be suppressed to be very small, so that pressure can be easily controlled by the capacity control valve V.

Furthermore, since the spool valve 50 includes the spool valve body 52 that can be moved relative to the stationary core 83 in the axial direction, the opening of the second communication passage 90 (spool-adjustment flow channel 92) can be accurately controlled by the driving force of the solenoid 80 and the flow rate of fluid in the second communication passage 90 can be variably controlled after the first valve 57 is closed. In addition, since the opening of the second communication passage 90 (i.e., the spool-adjustment flow channel 92) can be controlled by the spool valve 50 so that it is difficult for foreign matters contained in fluid to be bitten, the deterioration of resistance to foreign matters caused by the installation of the valve can be prevented.

Further, in a case where the right end 70*a* of the adapter 70 of the pressure sensitive body 60 in the axial direction is separated from the valve seat 55*a* of the third valve body 55 and the relief valve 59 is opened, fluid can be discharged to the suction chamber 3 from the control chamber 4 through the first communication passage 56 that are hollow holes formed in the first valve body 53, the second valve body 54, and the third valve body 55 in the axial direction. Accordingly, the first communication passage 56 can ensure a large cross-sectional area of the flow channel in the capacity control valve V, so that the control pressure Pc in the control chamber 4 of the variable-capacity compressor M can be quickly reduced.

Further, since the first communication passage 56 and the second communication passage 90 are parallel flow channels, the first communication passage 56 and the second communication passage 90 do not interfere with each other and an energy loss hardly occurs. Accordingly, fluid is easily discharged from the control chamber 4 through the first communication passage 56 and the second communication passage 90, so that the control pressure Pc can be quickly reduced.

Furthermore, the annular stepped portion 52*d* of the spool valve body 52 is engaged with the annular protrusion 54*b* of the second valve body 54 from the inner diameter side in the radial direction. Accordingly, even though the first valve body 53 causes a malfunction due to the influence of, for example, contaminations and the like entering a gap between the guide surface 10*c* of the valve housing 10 and the outer peripheral surface of the first valve body 53, a force for moving the first valve body 53 to the right side in the axial direction can be applied to the first valve body 53 by the spool valve body 52 engaged in the radial direction by the switching of the capacity control valve V to a state where current is not applied from a state where current is applied. Therefore, the opening of the first valve 57 (i.e., the first valve portion 53*a* of the first valve body 53 and the valve seat 12*c* of the valve housing 10) using the first valve body 53 and the closing of the second valve 58 (i.e., the second valve portion 54*a* of the second valve body 54 and the opening end face 83*g* of the sleeve portion 83*s* of the stationary core 83) can be reliably performed.

Further, current to be applied to the capacity control valve V is controlled to be increased so that the spool valve body 52 is moved relative to the first valve body 53, which causes a malfunction, to the left side in the axial direction by the driving force of the solenoid 80, and the coil spring 53*b* provided between the first valve body 53 and the spool valve body 52 is bent to increase a spring load. Accordingly, since a force for moving the first valve body 53 to the left side in the axial direction can be applied to the first valve body 53, the closing of the first valve 57 using the first valve body 53 and the opening of the second valve 58 using the spool valve body 52 can be reliably performed.

Further, since the stationary core 83 is used as a sleeve of the spool valve 50, a structure is simple.

Second Embodiment

Figure 8:
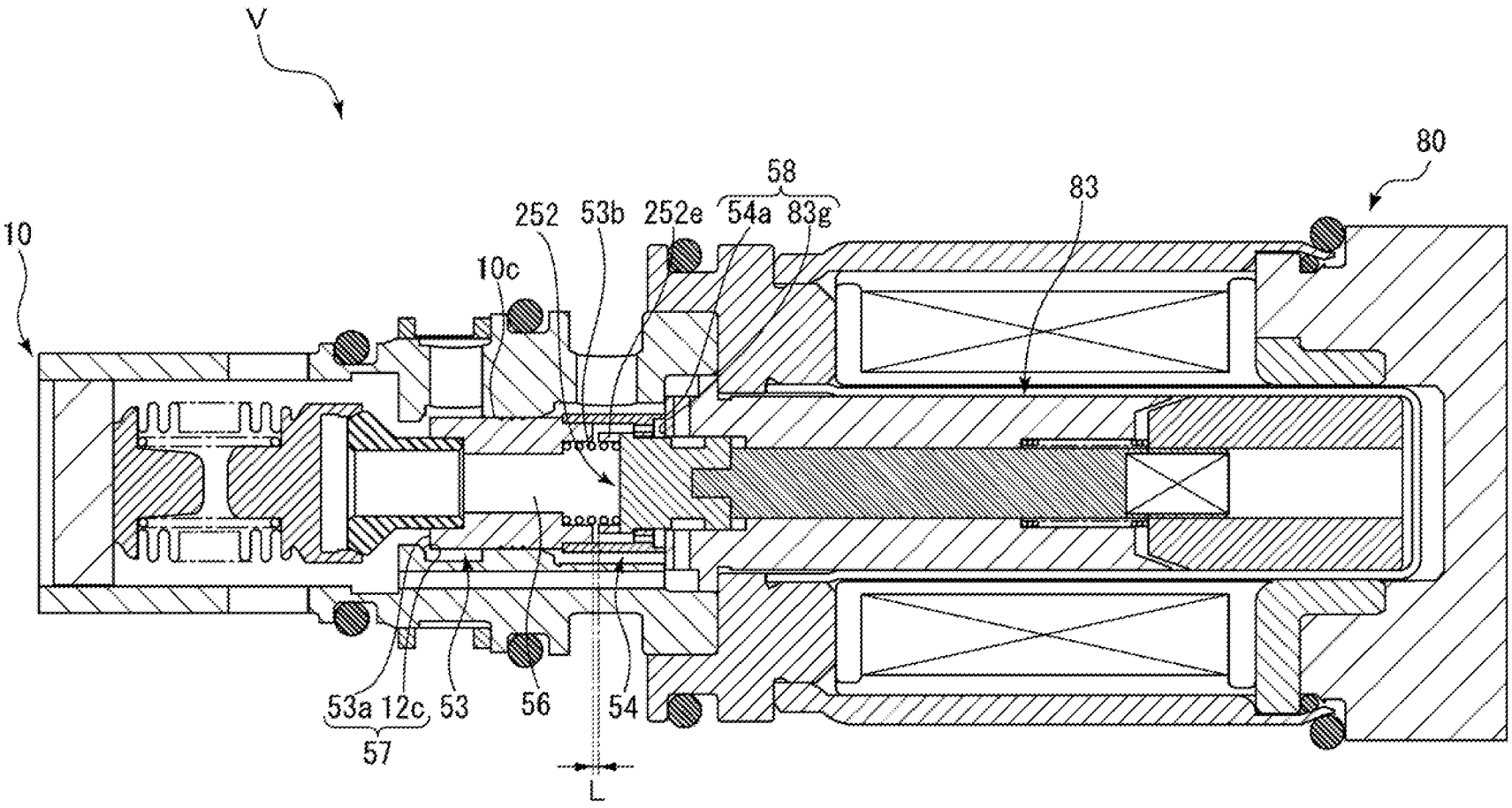
FIG. 8 is a cross-sectional view illustrating an aspect where a main valve is opened in a state where current is not applied to a capacity control valve according to a second embodiment of the present invention.

Next, a solenoid valve according to a second embodiment of the present invention will be described with reference to FIG. 8. The same components as the components illustrated in the embodiment are denoted by the same reference numerals as those of the aforesaid embodiment, and the repeated description thereof will be omitted.

A capacity control valve V according to the second embodiment of the present invention will be described. As illustrated in FIG. 8, a spool valve body 252 is formed separately from the first valve body 53 and is provided with a cylindrical protruding portion 252*e* extending to the left side in the axial direction so that the left end of the protruding portion 252*e* in the axial direction is fitted around the right end portion of the coil spring 53*b* in the axial direction. The protruding portion 252*e* is not limited to a structure where a separate member is fixed to the spool valve body 252, and may be formed integrally with the spool valve body 252. Further, the protruding portion 252*e* is not limited to a cylindrical portion, and may be formed of a plurality of protrusions separated from each other in the circumferential direction so that the flow of fluid in the first communication passage 56 is hardly blocked.

Furthermore, the maximum separation distance L in the axial direction between the first valve body 53 and the spool valve body 252 is set to be shorter than a distance (see FIGS. 5 and 6) where the spool valve body 252 is movable relative to the first valve body 53 in the axial direction.

According to this, even though the first valve body 53 causes a malfunction due to the influence of, for example, contaminations and the like entering a gap between the guide surface 10*c* of the valve housing 10 and the outer peripheral surface of the first valve body 53, current to be applied to the capacity control valve V can be controlled to be increased so that the protruding portion 252*e* of the spool valve body 252 relatively moved to the left side in the axial direction by the driving force of the solenoid 80 can come into contact with the right end of the first valve body 53 in the axial direction and can apply a force to the left side in the axial direction. Accordingly, the closing of the first valve 57 (the first valve portion 53*a* of the first valve body 53 and the valve seat 12*c* of the valve housing 10) using the first valve body 53 and the opening of the second valve 58 (the second valve portion 54*a* of the second valve body 54 and the opening end face 83*g* of the sleeve portion 83*s* of the stationary core 83) can be reliably performed.

Third Embodiment

Figure 9:
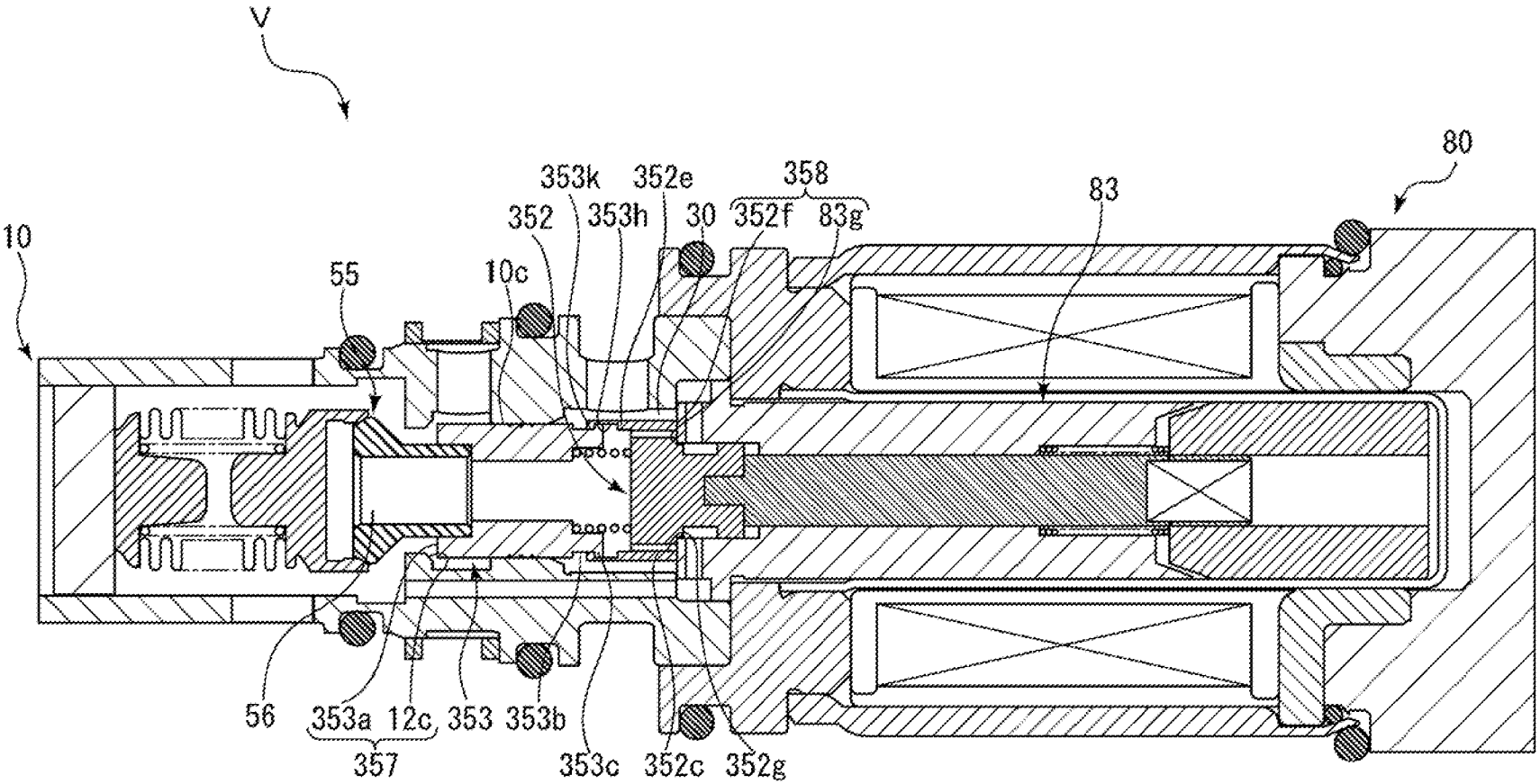
FIG. 9 is a cross-sectional view illustrating an aspect where a main valve is opened in a state where current is not applied to a capacity control valve according to a third embodiment of the present invention.

Next, a solenoid valve according to a third embodiment of the present invention will be described with reference to FIG. 9. The same components as the components illustrated in the embodiment are denoted by the same reference numerals as those of the above-mentioned embodiments, and the repeated description thereof will be omitted.

A capacity control valve V according to the third embodiment of the present invention will be described. As illustrated in FIG. 9, a first valve body 353 is formed in a substantially cylindrical shape and a substantially cylindrical third valve body 55 is fixed to the left end portion of the first valve body 353 in the axial direction.

An annular groove portion 353*b*, which is recessed radially inward over the circumferential direction, is formed at the right end portion of the outer peripheral surface of the first valve body 353 in the axial direction, and a flange portion 353*c* is formed on the right side of the annular groove portion 353*b* in the axial direction by the radially inward recess of the annular groove portion 353*b*.

A spool valve body 352 is formed separately from the first valve body 353, a flange portion 352*c* extending radially outward is formed at the left end portion of the spool valve body 352 in the axial direction, and a second valve portion 352*f* to be seated on an opening end face 83*g* of a sleeve portion 83*s* of a stationary core 83 of a second valve 358 is formed on the right end face of the flange portion 352*c* in the axial direction. A plurality of through-holes 352*g* extending in the axial direction are formed in the flange portion 352*c*, and a first communication passage 56, which is formed in the first valve body 353, and a second valve chamber 30 can communicate with each other through the through-holes 352*g*.

Further, a cylindrical protruding portion 352*e*, which extends to the left side in the axial direction, is formed at the left end portion of the flange portion 352*c* in the axial direction so as to be fitted around the right end portion of the first valve body 353 in the axial direction. An annular groove portion 353*h*, which is recessed radially outward over the circumferential direction, is formed on the inner peripheral surface of the protruding portion 352*e*, and a flange portion 353*k* is formed on the left side of the annular groove portion 353*h* in the axial direction.

The protruding portion 352*e* of the spool valve body 352 is fitted around the right end portion of the first valve body 353 in the axial direction and the flange portion 353*c* of the first valve body 353 and the flange portion 352*k* of the spool valve body 352 are engaged with each other in the radial direction, so that the first valve body 353 and the spool valve body 352 are connected to each other.

According to this, even though the first valve body 353 causes a malfunction due to the influence of, for example, contaminations and the like entering a gap between the guide surface 10*c* of the valve housing 10 and the outer peripheral surface of the first valve body 353, a force for moving the first valve body 353 to the right side in the axial direction can be applied to the first valve body 353 by the flange portion 352*k* of the spool valve body 352, which is engaged with the flange portion 353*c* of the first valve body 353 in the radial direction, by the switching of the capacity control valve V to a state where current is not applied from a state where current is applied. Accordingly, the opening of the first valve 357 (the first valve portion 353*a* of the first valve body 353 and the valve seat 12*c* of the valve housing 10) using the first valve body 353 and the closing of the second valve 358 (i.e., the second valve portion 352*f* of the spool valve body 352 and the opening end face 83*g* of the sleeve portion 83*s* of the stationary core 83) using the spool valve body 352 can be reliably performed.

Further, a distance where the spool valve body 352 is movable relative to the first valve body 353 in the axial direction can be adjusted by the adjustment of a range where the annular groove portion 353*b* of the first valve body 353 or the annular groove portion 352*h* of the spool valve body 352 is formed in the axial direction. Accordingly, current to be applied to the capacity control valve V can be controlled to be increased so that the flange portion 352*k* of the spool valve body 352 relatively moved to the left side in the axial direction by the driving force of the solenoid 80 can come into contact with the left end portion of the annular groove portion 353*b* of the first valve body 353 in the axial direction and can apply a force to the left side in the axial direction. Therefore, the closing of the first valve 357 using the first valve body 353 and the opening of the second valve 358 using the spool valve body 352 can be reliably performed. On the other hand, the right end portion of the annular groove portion 352*h* of the spool valve body 352, which is relatively moved to the left side in the axial direction, in the axial direction may come into contact with the right end of the first valve body 353 in the axial direction and may apply a force to the left side in the axial direction.

Fourth Embodiment

Figure 10:
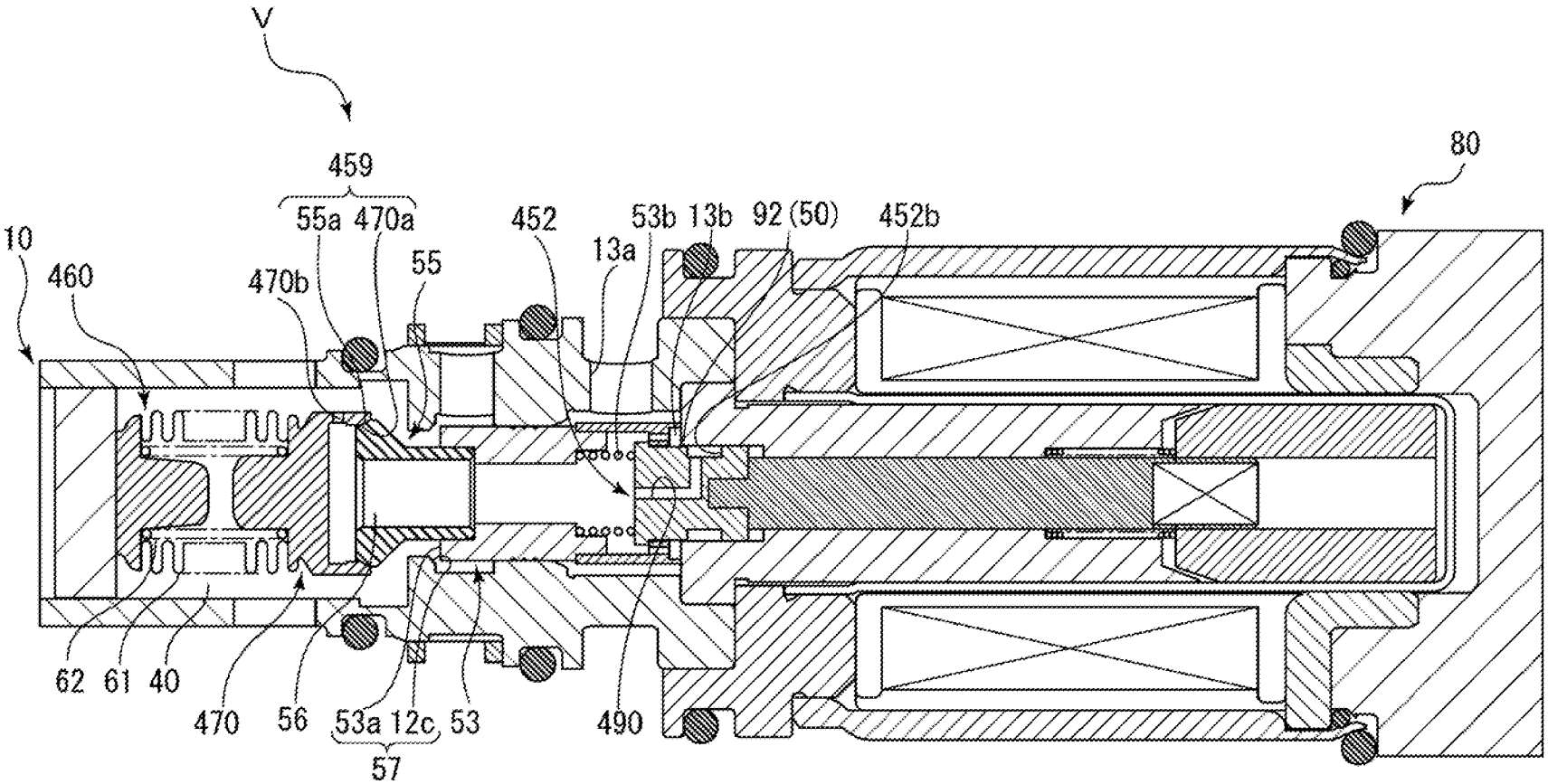
FIG. 10 is a cross-sectional view illustrating an aspect where a main valve is opened in a state where current is not applied to a capacity control valve according to a fourth embodiment of the present invention.

Next, a solenoid valve according to a fourth embodiment of the present invention will be described with reference to FIG. 10. The same components as the components illustrated in the embodiment are denoted by the same reference numerals as those of the aforesaid embodiments, and the repeated description thereof will be omitted.

A capacity control valve V according to the fourth embodiment of the present invention will be described. As illustrated in FIG. 10, a spool valve body 452 is formed separately from the first valve body 53 and a second communication passage 490 serving as a second flow channel is formed in the spool valve body 452. The second communication passage 490 extends to the right side in the axial direction from the radial center of the left end face of the spool valve body 452 in the axial direction, and is bent in the radial direction at the substantially middle portion of the spool valve body 452 in the axial direction to allow the first communication passage 56 and an annular groove portion 452*b* to communicate with each other.

A pressure sensitive body 460 mainly includes a bellows core 61 in which a coil spring 62 is built and an adapter 470 that is formed at the right end portion of the bellows core 61 in the axial direction. An auxiliary communication passage 470*b*, which penetrates the adapter 470 in the radial direction and allows the inside of the third valve chamber 40 and the first communication passage 56 to communicate with each other, is formed in the adapter 470.

According to this, the capacity control valve V can discharge fluid from the inside of the control chamber 4 in a short time by two flow channels, that is, a flow channel communicating with the first communication passage 56 in a case where a relief valve 459 is opened and a flow channel communicating with a second communication passage 490 of which the opening area is increased in a case where the spool valve 50 is opened. Accordingly, the control pressure Pc in the control chamber 4 can be quickly reduced at the time of the startup of the variable-capacity compressor M.

Further, even though the pressure sensitive body 460 expands due to a reduction in the control pressure Pc in the control chamber 4 at the time of the startup of the variable-capacity compressor M, the relief valve 459 is closed, and the first communication passage 56 forming a suction-side passage allowing the control chamber 4 and the suction chamber 3 to communicate with each other is closed, the capacity control valve V can cause high-pressure fluid present in the control chamber 4 to flow into the first communication passage 56 from the auxiliary communication passage 470*b* formed in the adapter 470, controls current to be applied to the capacity control valve V, causes the first valve portion 53*a* of the first valve body 53 to be seated on the valve seat 12*c* formed on the inner peripheral surface of the valve housing 10 by the driving force of the solenoid 80 to cause the first valve 57 to be closed, and then causes the coil spring 53*b* provided between the first valve body 53 and the spool valve body 452 to contract to further move the spool valve body 452 to the left side in the axial direction and to increase the opening of the second communication passage 490 (spool-adjustment flow channel 92). Accordingly, since the capacity control valve V can discharge high-pressure fluid, which is present in the control chamber 4 of the variable-capacity compressor M, to the suction chamber 3 through the second communication passage 490, the control pressure Pc in the control chamber 4 can be quickly reduced.

Fifth Embodiment

Figure 11:
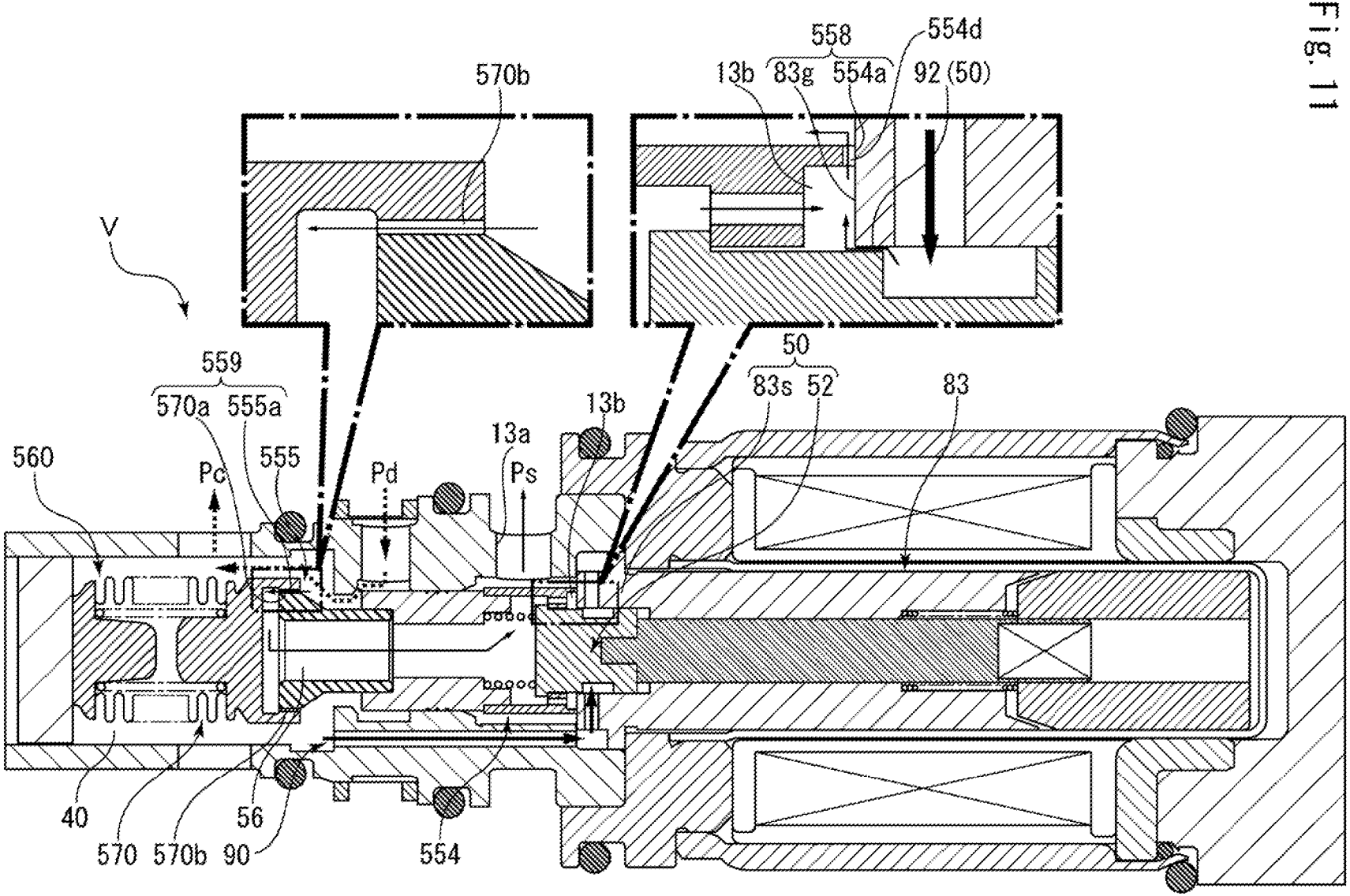
FIG. 11 is a cross-sectional view illustrating an aspect where a main valve is opened in a state where current is not applied to a capacity control valve according to a fifth embodiment of the present invention.

Next, a solenoid valve according to a fifth embodiment of the present invention will be described with reference to FIG. 11. The same components as the components illustrated in the embodiment are denoted by the same reference numerals as those of the above-mentioned embodiments, and the repeated description thereof will be omitted.

A capacity control valve V according to the fifth embodiment of the present invention will be described. As illustrated in FIG. 11, a second valve 558 includes a second valve portion 554*a* that is formed at the right end of a second valve body 554 in the axial direction and an opening end face 83*g* of a sleeve portion 83*s* serving as a sleeve of a stationary core 83 forming a communication passage 13*b*. Further, a plurality of slits 554*d* extending in the radial direction are formed in the second valve portion 554*a*, and communication passages 13*a* and 13*b* functioning as a suction-side passage always communicate with the slits 554*d*. The amount of fluid passing through the slits 554*d* is very small, and does not affect the control of pressure performed during the continuous drive by the capacity control valve V. In addition, the second valve body 554 may be provided with not the slits but through-holes that penetrate the second valve body in the radial direction. Further, the second valve body may be formed in the shape of a cylinder not provided with slits and through-holes, and the opening end face 83*g* of the sleeve portion 83*s* of the stationary core 83 facing the end portion of a cylindrical portion of the second valve body may be provided with recessed grooves extending in the radial direction.

A relief valve 559 includes a valve seat 555*a* that is formed on the outer peripheral surface of the left end portion of a third valve body 555 in the axial direction, and an inner peripheral surface 570*a* of an adapter 570 of a pressure sensitive body 560. Slits 570*b* serving as a plurality of orifice portions, which are recessed toward the outer diameter side and extend in the axial direction, are formed on the inner peripheral surface 570*a* of the adapter 570, and the third valve chamber 40 and the first communication passage 56 always communicate with each other through the slits 570*b*. The amount of fluid passing through the slits 570*b* is very small, and does not affect the control of pressure performed by the capacity control valve V. In addition, the inner peripheral surface 570*a* of the adapter 570 may be formed in a shape with no slit, and a plurality of slits, which are recessed toward the inner diameter side and extend in the axial direction, may be provided on the outer peripheral surface of the left end portion of the third valve body 555 in the axial direction.

Further, the relief valve 559 is adapted so that the valve seat 555*a* of the third valve body 555 is not released from the inside of the inner peripheral surface 570*a* of the adapter 570 even though the relative positions of the third valve body 555 and the adapter 570 in the axial direction are changed due to the movement of the third valve body 555 and the expansion and contraction of the pressure sensitive body 560 in a state where suction pressure Ps is low at the time of the control of the capacity control valve V. That is, the opening area of the relief valve 559 is determined by the slits 570*b*, and is maintained constant during continuous drive. In a state where the suction pressure Ps is much higher than pressure obtained during continuous drive, the valve seat 555*a* of the third valve body 555 is released from the inside of the inner peripheral surface 570*a* of the adapter 570 and the relief valve 559 is opened.

Further, the opening area of the second valve 558 (slits 554*d*) is always larger than the sum of the opening areas of the relief valve 559 (i.e., slits 570*b*) and the second communication passage 90 (i.e., spool-adjustment flow channel 92).

According to this, in a case where the second valve 558 and the relief valve 559 are closed in a state where current is not applied to the capacity control valve V, fluid present in the control chamber 4 flows into the suction chamber 3 from the slits 570*b* of the adapter 570 through the first communication passage 56 and the slits 554*d* of the second valve portion 554*a*. Accordingly, the pressure of the suction chamber 3 and the pressure of the control chamber 4 can be balanced and adjusted. The fluid present in the control chamber 4 can be caused to flow into the suction chamber 3 from the second communication passage 90 through the spool valve 50 and the slits 554*d* of the second valve portion 554*a* without flowing through the slits 570*b* of the adapter 570.

Figure 12:
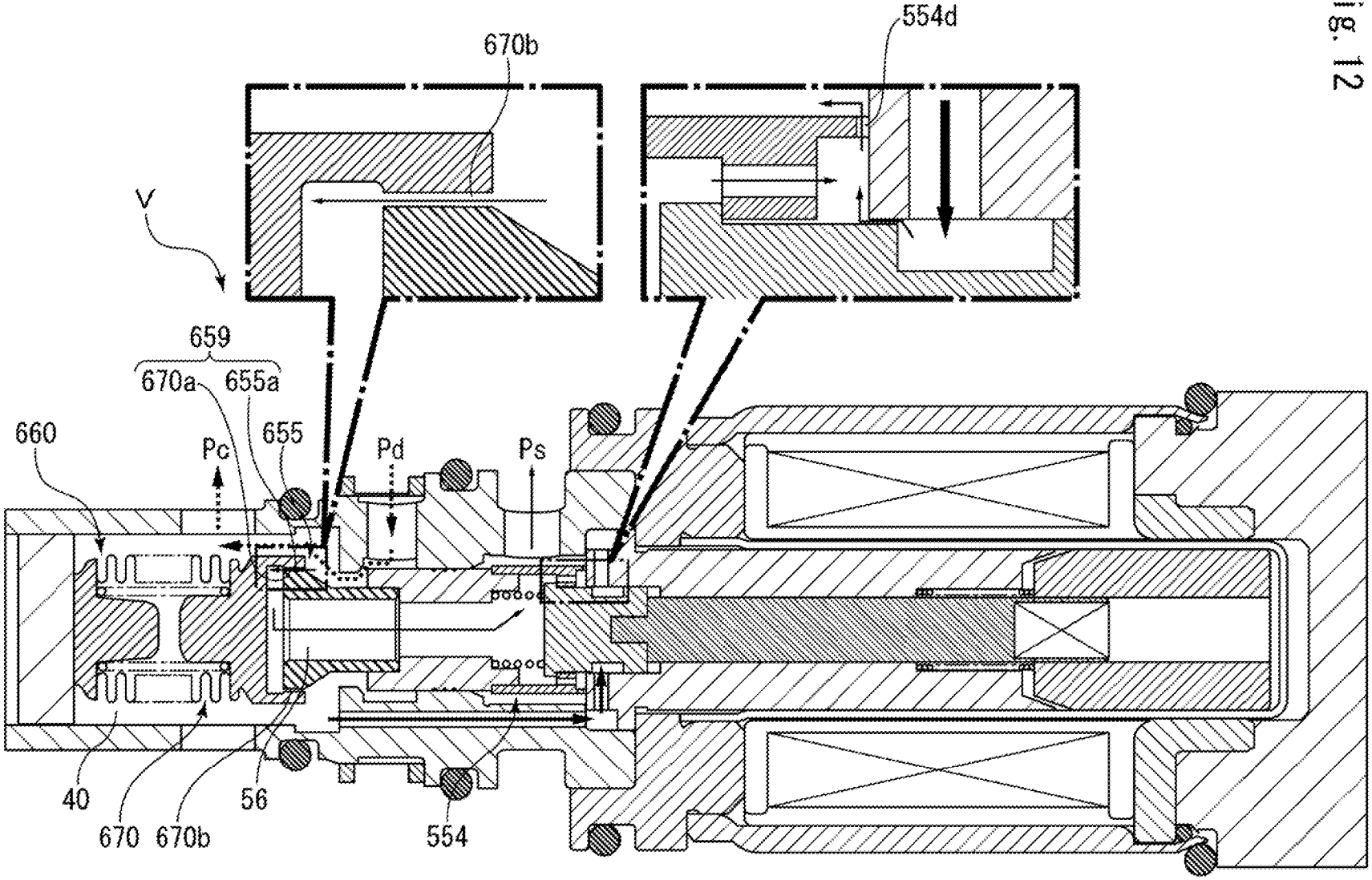
FIG. 12 is a cross-sectional view illustrating a first modification of the capacity control valve according to the fifth embodiment.

Further, there are the followings as the modifications of the orifice portion of the relief valve. As illustrated in FIG. 12, a relief valve 659 of a first modification includes a valve seat 655*a* that is formed on the outer peripheral surface of the left end portion of a third valve body 655 in the axial direction, and an inner peripheral surface 670*a* of an adapter 670 of a pressure sensitive body 660. Since the outer diameter of the valve seat 655*a* of the third valve body 655 is set to be slightly smaller than the inner diameter of the inner peripheral surface 670*a* of the adapter 670, a small gap 670*b* serving as an orifice portion extending in the axial direction is formed between the valve seat 655*a* of the third valve body 655 and the inner peripheral surface 670*a* of the adapter 670 and the third valve chamber 40 and the first communication passage 56 always communicate with each other through the small gap 670*b*. The amount of fluid passing through the small gap 670*b* is very small, and does not affect the control of the control pressure Pc at the time of the control of the capacity control valve V.

Figure 13:
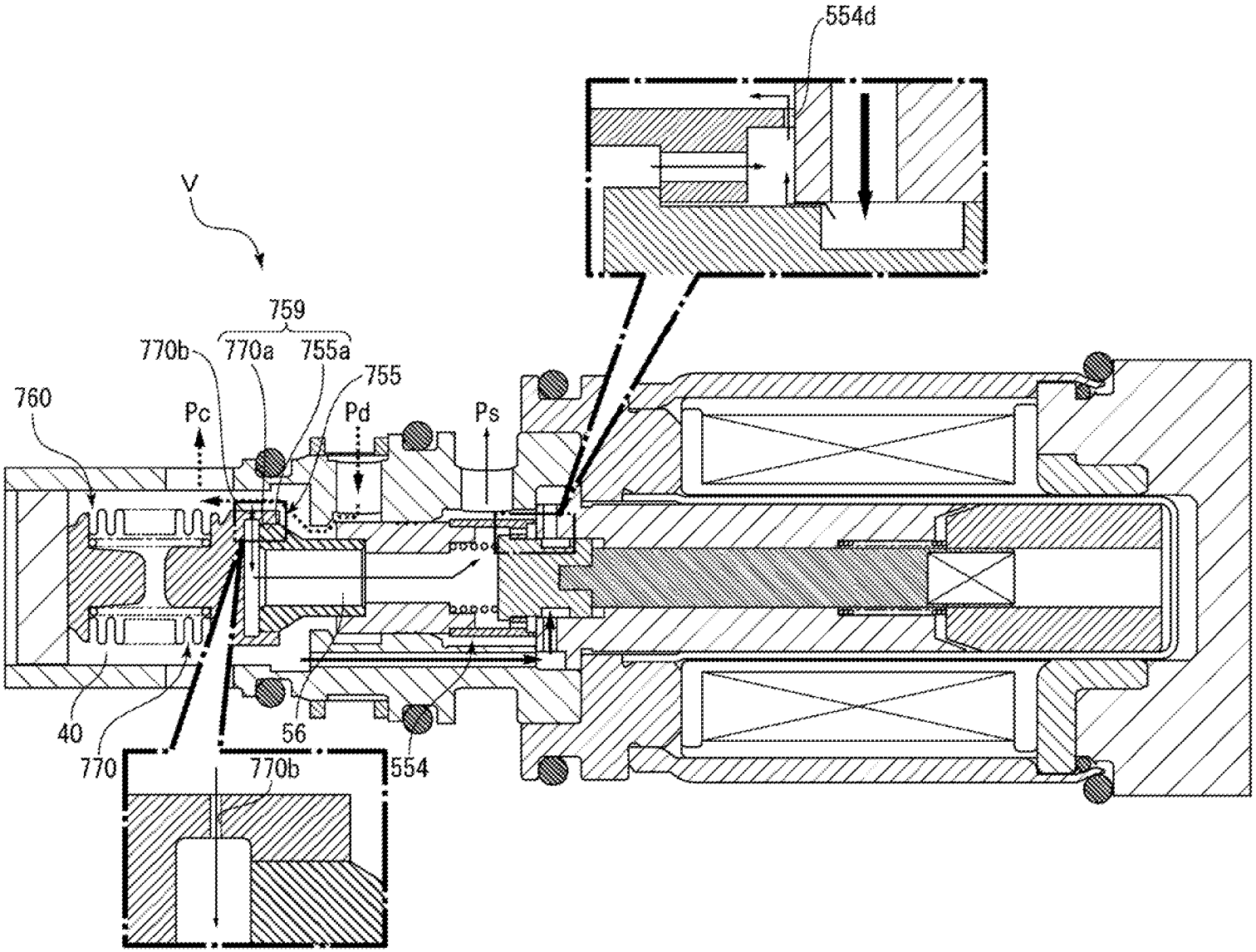
FIG. 13 is a cross-sectional view illustrating a second modification of the capacity control valve according to the fifth embodiment.

In addition, as illustrated in FIG. 13, a relief valve 759 of a second modification includes a valve seat 755*a* that is formed on the outer peripheral surface of the left end portion of a third valve body 755 in the axial direction, and an inner peripheral surface 770*a* of an adapter 770 of a pressure sensitive body 760. A through-hole 770*b* serving as an orifice portion extending in the radial direction is formed in the adapter 770, and the third valve chamber 40 and the first communication passage 56 always communicate with each other through the through-hole 770*b*. The amount of fluid passing through the through-hole 770*b* is very small, and does not affect the control of the control pressure Pc at the time of the control of the capacity control valve V.

Figure 14:
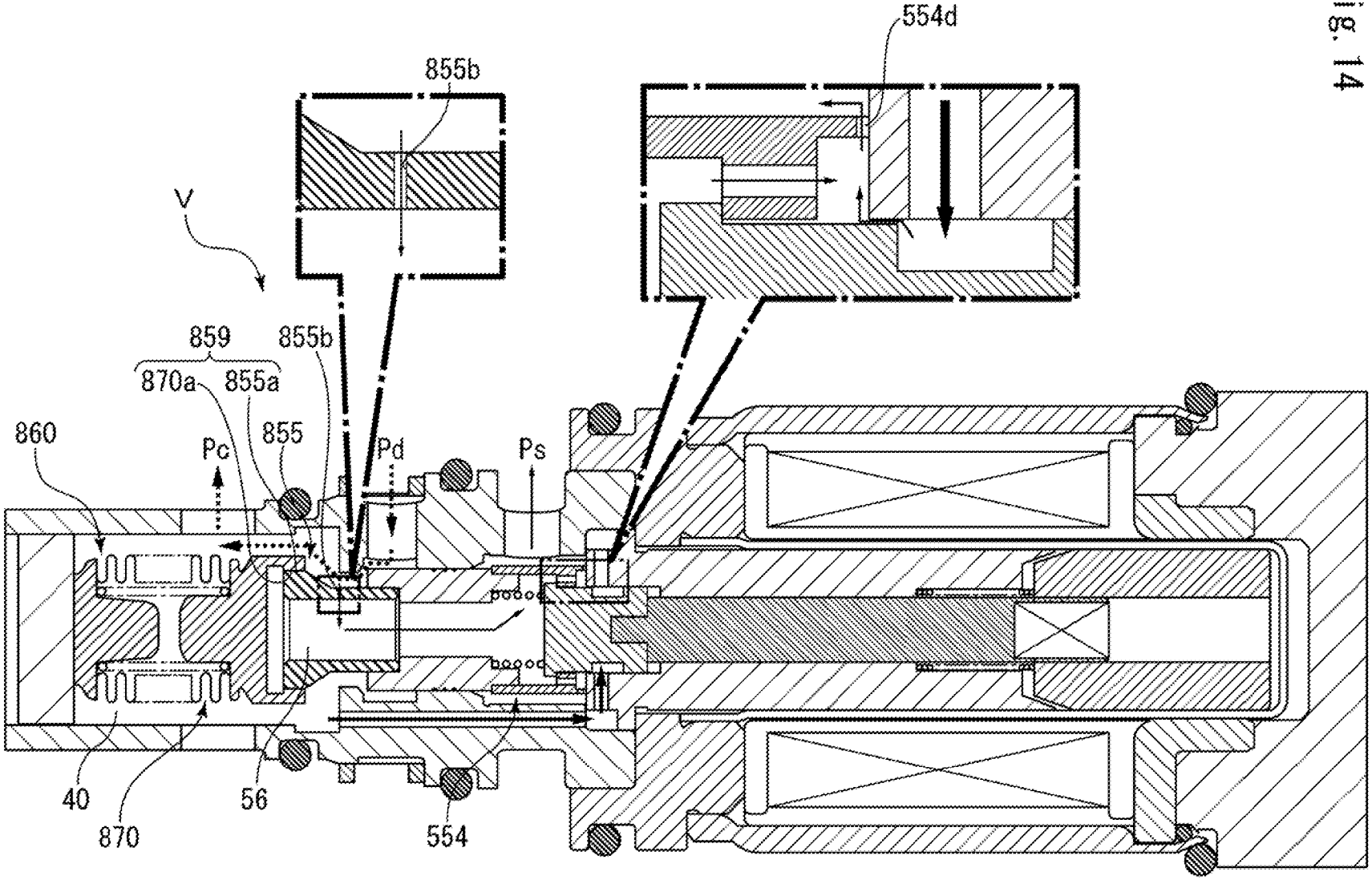
FIG. 14 is a cross-sectional view illustrating a third modification of the capacity control valve according to the fifth embodiment.
Figure 15:
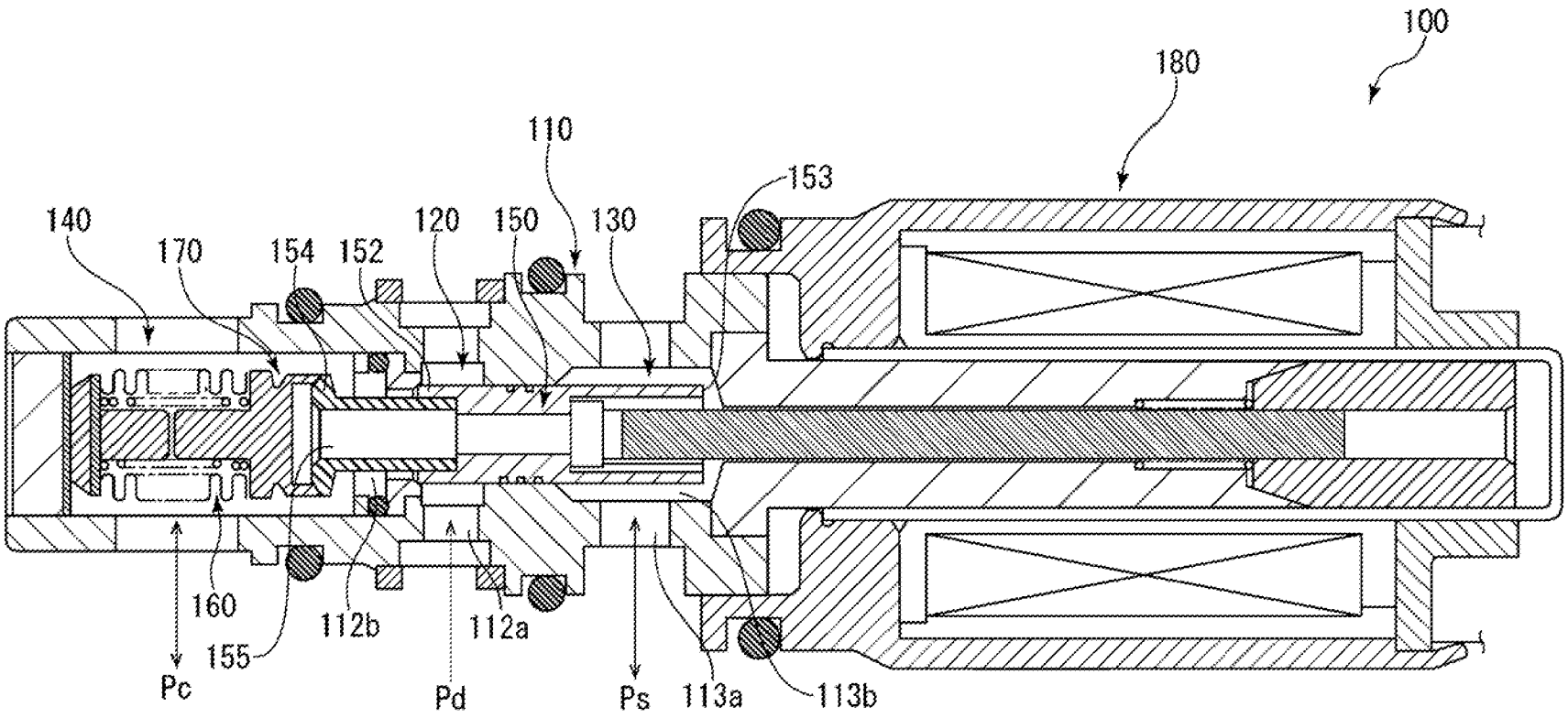
FIG. 15 is a cross-sectional view illustrating an aspect where a main valve is closed in a state where current is applied to a capacity control valve disclosed in Patent Citation 1 disclosing an example of the related art.

Moreover, as illustrated in FIG. 14, a relief valve 859 of a third modification includes a valve seat 855*a* that is formed on the outer peripheral surface of the left end portion of a third valve body 855 in the axial direction, and an inner peripheral surface 870*a* of an adapter 870 of a pressure sensitive body 860. A through-hole 855*b* serving as an orifice portion extending in the radial direction is formed in the third valve body 855, and the third valve chamber 40 and the first communication passage 56 always communicate with each other through the through-hole 855*b*. The amount of fluid passing through the through-hole 855*b* is very small, and does not affect the control of the control pressure Pc at the time of the control of the capacity control valve V.

According to this, in a case where the second valve 558 and the relief valves 659, 759, and 859 of the first to third modifications are closed in a state where current is not applied to the capacity control valve V, fluid present in the control chamber 4 flows into the suction chambers 3 from the small gap 670*b* formed between the valve seat 655*a* of the third valve body 655 and the inner peripheral surface 670*a* of the adapter 670, the through-hole 770*b* of the adapter 770, and the through-hole 855*b* of the third valve body 855 through the first communication passage 56 and the slits 554*d* of the second valve portion 554*a*. Accordingly, the pressure of the suction chamber 3 and the pressure of the control chamber 4 can be balanced and adjusted.

The embodiments of the present invention have been described above with reference to the drawings, but specific configuration is not limited to these embodiments. Even though modifications or additions are provided without departing from the scope of the present invention, the modifications or additions are included in the present invention.

Further, aspects where the third valve chamber 40 includes the relief valve, the pressure sensitive body, and the like have been described in the first to third embodiments and the fifth embodiment, but the present invention is not limited thereto. The pressure sensitive body and the like may be omitted and a pressure chamber including only one end of the second communication passage 90 for causing fluid to flow into the second valve chamber 30 may be provided. In this case, the first communication passage may not be formed in the first valve body.

Further, the second valve may not be provided in the first to fourth embodiments. The second valve body may function as only a support member to be subjected to a load in the axial direction as in the fifth embodiment, and does not necessarily need to have a sealing function.

Furthermore, the second valve chamber 30 may be provided on a side opposite to the solenoid 80 in the axial direction, and the third valve chamber 40 may be provided on a side facing the solenoid 80.

Moreover, an aspect where a part of the second communication passage 90 is formed at the end portion of the stationary core 83 closing one end of the valve housing 10 has been described, but the present invention is not limited thereto. The second communication passage 90 may be formed in only the valve housing 10. For example, an aspect where an axial hole and a radial hole communicating with the axial hole may be formed in the valve housing 10 may be provided. Further, the second communication passage 90 may be formed in a member separate from the valve housing 10 and the stationary core 83.

Furthermore, a plurality of through-holes 90*a* of the second communication passage 90 may be formed as long as the structural strength of the valve housing 10 is allowed.

Further, an aspect where only one communication passage 12*a* and only one communication passage 13*a* are formed on the same side of the valve housing 10 has been described, but the present invention is not limited thereto. A plurality of communication passages may be formed in the circumferential direction as long as the structural strength of the valve housing 10 is allowed.

An aspect where the discharge pressure Pd, the suction pressure Ps, and the control pressure Pc become uniform pressure in a case where the variable-capacity compressor M is left for a long time has been described, but the present invention is not limited thereto. An aspect where only the suction pressure Ps is always slightly low may be provided.

Furthermore, the pressure sensitive body may be a pressure sensitive body that does not use a coil spring in a bellows core.

REFERENCE SIGNS LIST

1 Casing
2 Discharge chamber
3 Suction chamber

4 Control chamber
10 Valve housing
12*a* Communication passage (discharge port, discharge-side passage)
12*b* Communication passage (discharge-side passage)
12*c* Valve seat (main valve seat portion)
13*a* Communication passage (suction port, suction-side passage)
13*b* Communication passage (suction-side passage)
14*a* Communication passage (control port, discharge-side passage, and suction-side passage)
20 First valve chamber
30 Second valve chamber
40 Third valve chamber
50 Spool valve
52 Spool valve body
52*b* Annular groove portion (second communication passage)
53 First valve body (main valve body)
53*a* First valve portion (main valve portion)
53*b* Coil spring (spring)
54 Second valve body
55 Third valve body
56 First communication passage (first flow channel, hollow hole)
57 First valve (main valve)
58 Second valve
59 Relief valve
60 Pressure sensitive body
61 Bellows core
62 Coil spring
70 Adapter
80 Solenoid
83 Stationary core
83*f* Through-hole (second communication passage)
83*s* Sleeve portion (sleeve)
90 Second communication passage (second flow channel)
90*a* Through-hole (second communication passage)
91 Connecting space (second communication passage)
92 Spool-adjustment flow channel (second communication passage)
252 Spool valve body
352 Spool valve body
353 First valve body (main valve body)
452 Spool valve body
459 Relief valve
460 Pressure sensitive body
470 Adapter
470*b* Auxiliary communication passage
490 Second communication passage (second flow channel)
554 Second valve body
554*d* Slit
559 Relief valve
570 Adapter
570*b* Slit (orifice portion)
659 Relief valve
670*b* Small gap (orifice portion)
759 Relief valve
770 Adapter
770*b* Through-hole (orifice portion)
855 Third valve body
855*b* Through-hole (orifice portion)
859 Relief valve
L Maximum separation distance
Pc Control pressure
Pd Discharge pressure
Ps Suction pressure
V Capacity control valve

The invention claimed is:

1. A capacity control valve comprising:
a valve housing having a main valve seat portion formed on an inner peripheral surface thereof;
a main valve body that has a main valve portion configured to seat on the main valve seat portion and configured to block communication between a discharge port and a control port depending on a driving force of a solenoid;
a relief valve configured to be opened by pressure;
a first flow channel configured to allow the control port and a suction port to communicate with each other in a case where the relief valve is opened;
a second flow channel that is formed at least partially in parallel with the first flow channel and configured to allow the control port and the suction port to communicate with each other; and
a spool valve body that is reciprocally disposed in a sleeve and configured to adjust an opening of the second flow channel depending on the driving force of the solenoid,
wherein, after the main valve portion is seated on the main valve seat portion, the spool valve body is further moved by the driving force of the solenoid and increases the opening of the second flow channel, and
the main valve body and the spool valve body respectively have projections configured to protrude in opposite radial directions and configured to engage with each other by bringing the projections into contact with each other.

2. The capacity control valve according to claim 1,
wherein the first flow channel is a hollow hole that is formed in the main valve body and configured to extend in an axial direction of the main valve body.

3. The capacity control valve according to claim 1,
wherein at least part of the second flow channel is a through-hole formed in the valve housing.

4. The capacity control valve according to claim 1, further comprising an orifice portion configured to always allow the control port and the suction port to communicate with each other through the first flow channel regardless of an action of the relief valve.

5. The capacity control valve according to claim 1,
wherein the spool valve body is positioned at a position where the opening of the second flow channel is maintained at least at a minimum opening area when the main valve portion is seated on the main valve seat portion.

6. The capacity control valve according to claim 5,
wherein the main valve body and the spool valve body are disposed and configured to reciprocate in an axial direction.

7. The capacity control valve according to claim 5,
wherein the first flow channel is a hollow hole that is formed in the main valve body and configured to extend in an axial direction of the main valve body.

8. The capacity control valve according to claim 5,
wherein at least part of the second flow channel is a through-hole formed in the valve housing.

9. The capacity control valve according to claim 5, further comprising an orifice portion configured to always allow the control port and the suction port to communicate with each other through the first flow channel regardless of an action of the relief valve.

10. The capacity control valve according to claim 1, wherein the main valve body and the spool valve body are disposed and configured to reciprocate in an axial direction.

11. The capacity control valve according to claim 10, wherein the first flow channel is a hollow hole that is formed in the main valve body and configured to extend in an axial direction of the main valve body.

12. The capacity control valve according to claim 10, wherein at least part of the second flow channel is a through-hole formed in the valve housing.

13. The capacity control valve according to claim 10, further comprising an orifice portion configured to always allow the control port and the suction port to communicate with each other through the first flow channel regardless of an action of the relief valve.

* * * * *